US010100554B2

(12) United States Patent
Michael et al.

(10) Patent No.: US 10,100,554 B2
(45) Date of Patent: Oct. 16, 2018

(54) GRAVITY-ACTUATED LATCH MECHANISM

(71) Applicant: NORTHLAND PRODUCTS, INC., Prescott, AZ (US)

(72) Inventors: William J. Michael, Chino Valley, AZ (US); Reed A. Davis, Prescott, AZ (US)

(73) Assignee: Northland Products, Inc., Prescott, AZ (US)

( * ) Notice: Subject to any disclaimer, the term of this patent is extended or adjusted under 35 U.S.C. 154(b) by 423 days.

(21) Appl. No.: 14/835,262

(22) Filed: Aug. 25, 2015

(65) Prior Publication Data

US 2016/0060898 A1 Mar. 3, 2016

Related U.S. Application Data

(60) Provisional application No. 62/042,047, filed on Aug. 26, 2014, provisional application No. 62/109,886, filed on Jan. 30, 2015.

(51) Int. Cl.

| | |
|---|---|
| ***E05C 3/06*** | (2006.01) |
| ***E05B 15/00*** | (2006.01) |
| ***E05B 65/52*** | (2006.01) |
| ***E05C 3/24*** | (2006.01) |
| ***B65F 1/16*** | (2006.01) |

(52) U.S. Cl.
CPC ..... *E05B 15/0093* (2013.01); *B65F 1/1615* (2013.01); *E05B 65/5292* (2013.01); *E05C 3/24* (2013.01)

(58) Field of Classification Search
CPC ..... Y10T 292/1063; Y10T 292/14; Y10T 292/0937; Y10T 70/5522; Y10T 292/1006; Y10S 220/908; Y10S 292/04; E05B 15/0093; E05B 65/5292
See application file for complete search history.

(56) References Cited

U.S. PATENT DOCUMENTS 4,844,113 A * 7/1989 Jones ..... F16K 17/363 137/39
5,094,358 A * 3/1992 Serio, Sr. ..... E05C 3/048 220/315
5,224,744 A * 7/1993 Michelutti ..... B65F 1/1615 220/908

(Continued)

*Primary Examiner* — Mark A Williams
(74) *Attorney, Agent, or Firm* — Schmeiser, Olsen & Watts LLP

(57) ABSTRACT

A gravity-actuated latch mechanism is provided. The gravity-actuated latch mechanism may include a strike attached to a lid of a container and a latch body attached to an inside wall of the container. The latch body includes a housing and a catch accessible from outside of the housing, wherein the catch engages and disengages with the strike. The latch body includes a lever having a lever arm moveable between an engaged and disengaged position. The engaged position is engaged with the catch and the disengaged position is disengaged with the catch. The latch body also includes a latch actuation ball housed in an elongated passage within the housing. The lever arm of the lever extends into the elongate passage, allowing the latch actuation ball to apply force to the lever arm to move the lever from the engaged to the disengaged position in response to tipping the container for dumping.

15 Claims, 17 Drawing Sheets

(56) References Cited

U.S. PATENT DOCUMENTS 5,474,341 A * 12/1995 Putman ..... B65F 1/1615
220/315
5,599,050 A * 2/1997 Tinsley ..... B65F 1/1615
220/908
5,697,655 A * 12/1997 Strong ..... E05C 3/14
292/230
6,382,688 B1 * 5/2002 Agostini ..... E05B 77/06
292/336.3
6,550,827 B1 * 4/2003 Tsujino ..... E05B 15/0093
292/252
6,802,550 B1 * 10/2004 Griggs, Jr. ..... B60N 2/4686
292/136
7,540,393 B2 * 6/2009 Wong ..... B65F 1/02
220/324
7,597,365 B2 * 10/2009 Kreitzer ..... B65F 1/1615
292/148
8,960,735 B2 * 2/2015 Michael ..... E05C 3/24
292/100

* cited by examiner

20

GRAVITY-ACTUATED LATCH MECHANISM

CROSS REFERENCE TO RELATED APPLICATION(S)

This application claims priority to U.S. Provisional Patent Application "Gravity-Actuated Latch Mechanism," Ser. No. 62/042,047, filed 26 Aug. 2014, and claims priority to U.S. Provisional Patent Application "Gravity-Actuated Latch Mechanism," Ser. No. 62/109,886, filed 30 Jan. 2015, the disclosures of which are hereby incorporated entirely herein by reference.

TECHNICAL FIELD OF THE INVENTION

The present invention relates generally to latch mechanisms for containers. More specifically, the present invention relates to a gravity-actuated latch mechanism for selectively restricting access to a container.

BACKGROUND OF THE INVENTION

Food and food-containing refuse generated by humans often attract the attention of animals. Animals have a keen sense of smell and can easily detect food which has been discarded in containers left outdoors such as refuse bins and storage lockers. Once food has been discovered in such areas, the animals often return to these outdoor containers in the hope of finding additional food.

Animals in pursuit of a readily available source of food are problematic to human populated areas. For example, animals sometimes enter homes, garages, or even vehicles in search of food where they inflict significant property damage. Furthermore, animals entering human inhabited areas can become injured or killed by moving vehicles, electrical lines, and other human accoutrements. Still further, these animals can lose their wariness towards humans, making them a potential threat to humans. Thus, to protect people, property, and the animals themselves, it is desirable to inhibit animals from accessing containers in which refuse and food are stored.

Various attempts have been made to prevent animals from getting into outdoor refuse containers and food storage lockers. For example, refuse containers are sometimes stored inside sturdy locked buildings, in roofed chain link enclosures, and so forth. Unfortunately, food refuse in an enclosure still gives off orders that attract wildlife. Thus, it is critical that such an enclosure be locked and that the enclosure is sufficiently sturdy to dissuade a clever and persistent intruder.

In addition, or alternatively, refuse containers may be outfitted with a latch system to prevent an animal from opening the container. Some latch systems can be problematic, however, because they can be difficult for a user to manipulate. Furthermore, some latch systems typically require the user to unlatch and subsequently re-engage the latch after use. If the latch is not re-engaged the container is not protected from animal access. Additionally, some latch systems can still be opened by animals, such as raccoons, through luck, persistence, or cleverness, or by bears through force or turning the refuse containers completely upside-down.

Another approach is to build the container using heavy, reinforcing components designed to inhibit animals from physically damaging the container in order to gain access. These reinforcing components can make the container undesirably heavy and unwieldy to move. In addition, these heavy, reinforcing components can cause premature damage, such as failure of the container hinges after repeated use. Furthermore, such reinforced containers may be unnecessary in regions having only small animals, such as raccoons, squirrels, and the like that are unable to physically damage a conventional container.

In an effort to control costs associated with refuse collection, many municipalities are implementing "fully-automated collection" techniques. Fully-automated collection involves the use of a truck with an automated, mechanical gripping arm to lift a specially-designed container from the curbside, dump the container contents into the truck, and return the container to the curbside. Such a system typically requires only one person to operate because the truck driver controls the gripping arm from the cab of the truck. In contrast, traditional collection systems require one or two laborers and a driver to collect refuse.

Fully-automated collection relies on the cooperation of the residents to place the refuse containers in the proper location and position for collection. Unless the resident places the refuse container in the proper location at the moment that the truck approaches, a container without a latch system is vulnerable to animals while the container awaits refuse collection. Additionally, the container is vulnerable to weather conditions, such as high winds, that can potentially knock over the container causing the refuse to at least partially dump out. A container with a latch system is also problematic because when the container is placed in the proper location, it must be unlatched so that the contents of the container will be successfully emptied. Accordingly, a container with a disengaged latch system is also vulnerable to animals while the container awaits refuse collection. Alternatively, the refuse vehicle operator may exit the truck to disengage the latch system. However, such a procedure is undesirably inconvenient and time consuming. A container using heavy, reinforcing components may be difficult for a resident to place in the proper location and may not conform with the size, shape, and weight requirements needed to safely function with the automated, mechanical arm.

Accordingly, what is needed is a latch mechanism for restricting access to a container that is easy to use, mechanically robust, cost effective, and is compatible with fully-automated collection systems.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, the Figures are not necessarily drawn to scale, and:

DETAILED DESCRIPTION

Embodiments of the invention entail a gravity-actuated latch mechanism that may be utilized in conjunction with an enclosure, such as a container with a lid. The latch mechanism may be implemented with a refuse container, lock box, or any other container that may receive and hold items such as food, garbage, trash, recyclable items, and so forth. More particularly, the latch mechanism is configured to inhibit smaller animals such as raccoons, squirrels, dogs, and the like, from accessing the contents of the container. Furthermore, the latch mechanism is configured to resist unlatching in the instance that the container is tipped over by, for example, the wind or an animal. The latch mechanism automatically engages so that a user need not deliberately re-engage the latch after placing refuse in the container. Furthermore, the latch mechanism can be unlatched by an automated, mechanical arm of a refuse truck so that the contents of the container can be emptied during automated collection. Although the gravity-actuated latch mechanism is directed towards inhibiting access of animals to a refuse container used for automated collection, embodiments of the invention may be applied to inhibiting access of animals in general to containers. Additionally, the latch mechanism may be implemented to allow controlled access to a multitude of container designs, cupboards, gates, and the like.

Figure 1:
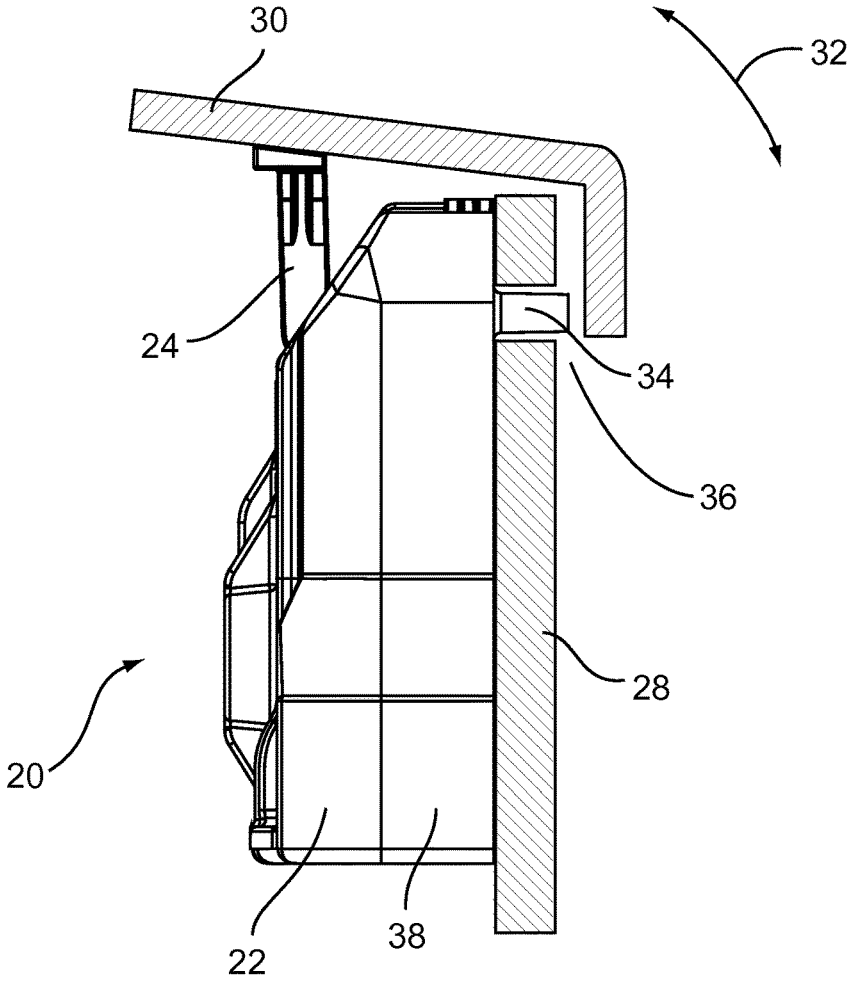
FIG. 1 shows a side view of a gravity-actuated latch mechanism in accordance with an embodiment.
Figure 2:
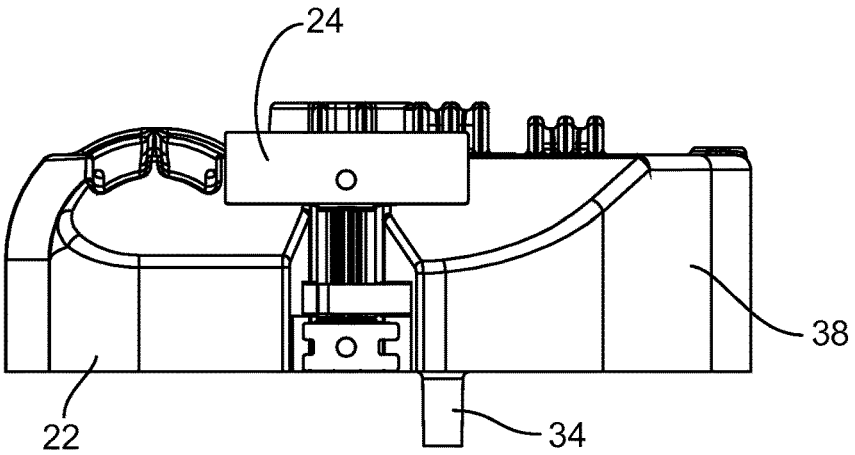
FIG. 2 shows a top view of the gravity-actuated latch mechanism.
Figure 3:
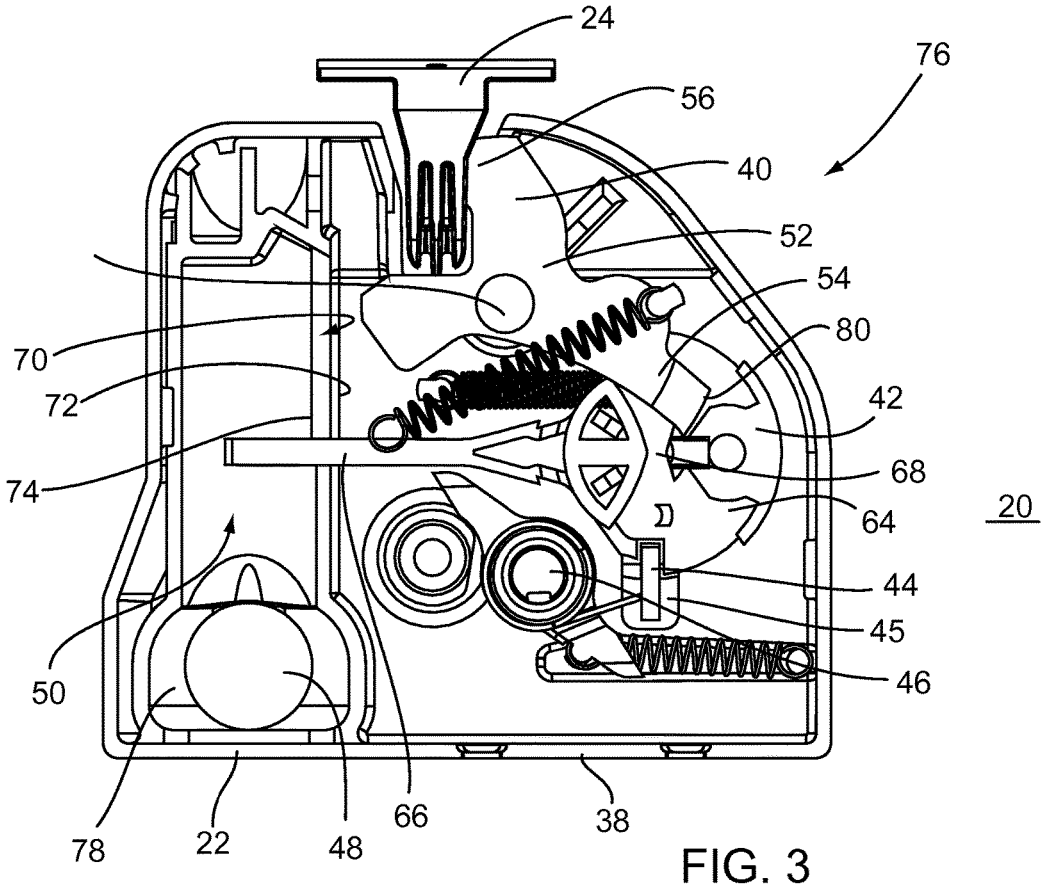
FIG. 3 shows a front view of the gravity-actuated latch mechanism.
Figure 4:
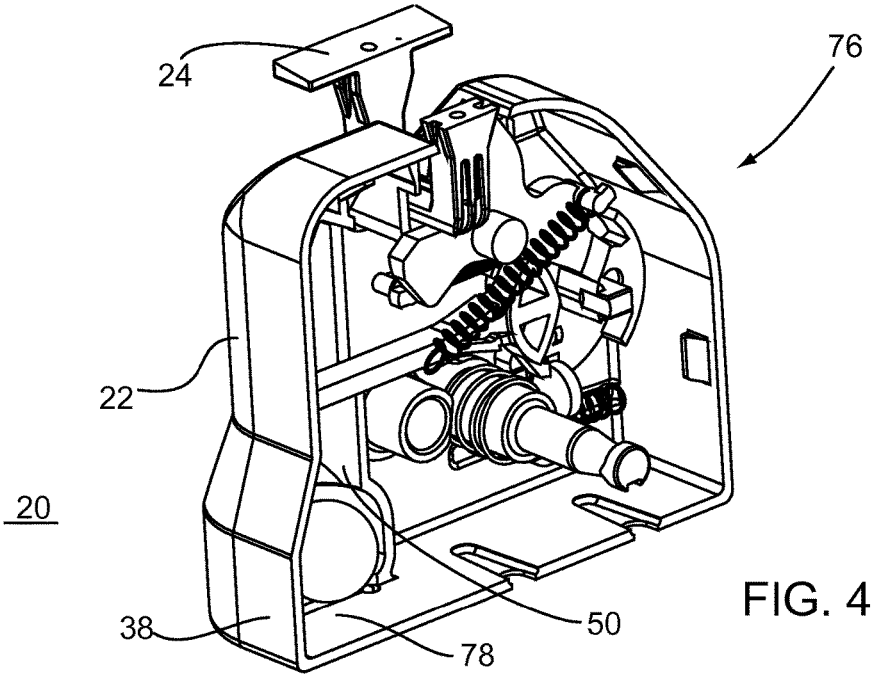
FIG. 4 shows a front perspective view of gravity-actuated latch mechanism.

Referring to FIGS. 1-4, FIG. 1 shows a side view of a gravity-actuated latch mechanism 20 in accordance with an embodiment. FIG. 2 shows a top view of gravity-actuated latch mechanism 20. FIG. 3 shows a front view of gravity-actuated latch mechanism 20, and FIG. 4 shows a front perspective view of gravity-actuated latch mechanism 20. In FIGS. 3 and 4, a front panel of latch mechanism 20 has been removed to better visualize the internal components (discussed below) of latch mechanism 20.

In an embodiment, latch mechanism 20 includes a latch body 22 and a strike 24. In general, latch body 22 is adapted to be secured to an inside front wall 28 of a container 26 with a top edge of latch body being mounted flush with the top edge of front wall 28. Strike 24 is adapted to be fastened to a lid 30 that closes, or covers, an opening into container 26. For purposes of illustration, a portion of container 26 with lid 30 is shown in FIG. 1. A bi-directional curved arrow 32 shows a direction of movement of lid 30 relative to front wall 28 of container 26. That is, a hinged member (not shown) interconnects lid 30 with a back wall (not shown) of container 26 to enable movement of lid 30 relative to container 26.

In an embodiment, an alignment post 34 extending outwardly from latch body 22 is directed through an opening 36 extending through front wall 28. Another fastener (not shown) may extend through another opening (not shown) in front wall 28 and secure to, for example, a threaded opening (not shown) in latch body 22. Those skilled in the art will recognize that a variety of fasteners and fastening techniques may be implemented to secure latch body 22 to front wall 28 of container 26. Similarly, strike 24 may be fastened to lid 30 utilizing a variety of fasteners and fastening techniques known to those skilled in the art.

Latch body 22 functions cooperatively with strike 24 so that lid 30 is secured to front wall 28 of container 26 to inhibit intrusion into container 26, as will be discussed in greater detail below. In addition, latch mechanism 20 can be readily actuated by a gravity effect when the gripping arm of an automated collection refuse pickup vehicle picks up and tilts container 26 to disengage strike 24 from latch body 22, as will also be discussed in greater detail below.

Referring more particularly to FIGS. 3 and 4, multiple components of latch mechanism 20 reside within a housing 38 of latch body 22, with strike 24 extending out of the top of housing 38. The components of latch mechanism generally include a catch 40, a lever 42, a disc member 44 housed in a cavity 45, a manual open actuator 46, and a latch actuation ball 48 housed in an elongated passage 50 within housing 38.

Catch 40 includes a first end 52 and a second end 54. A hook 56 is located at first end 52 of catch 40 and is adapted to engage with strike 24. A mating surface 58 is located at second end 54 of catch 40 and is adapted to at least partially engage with lever 42 (discussed below). When actuated, catch 40 is adapted to selectively pivot, or rotate, about a pivot axis 60 to release hook 56 from engagement with strike 24. Lever 42 includes a pivot body 64 and a lever arm 66 extending from pivot body 64. Lever 42 is adapted to selectively pivot, or rotate, about another pivot axis 68. Lever arm 66 extends through a slot 70 in a wall 72 enclosing elongated passage 50 so that a distal end 74 of lever arm 66 resides in elongated passage 50.

FIGS. 3 and 4 show latch mechanism 20 in a latched configuration 76. More particularly, latch actuation ball 48 resides at the bottom of elongated passage 50 in a reservoir portion 78 of passage 50 when latch mechanism 20 is upright due to the effect of gravity. Distal end 74 of lever arm 66 is oriented approximately horizontal so that a latching surface 80 extending outwardly from pivot body 64 of lever 42 abuts, latches to, or otherwise engages with mating surface 58 at second end 54 of catch 40. The engagement between latching surface 80 of lever 42 and mating surface 58 of catch 40 largely prevents catch 40 from pivoting about pivot point 60 so that hook 56 remains engaged with strike 24.

Disc member 44 is implemented as an adjunct to the engagement capability between latching surface 80 of lever 42 and mating surface 58 of catch 40. In particular, when latch mechanism 20 is in latched configuration 76, disc member 44 within cavity 45 is located within a notch 82 (visible in FIG. 7) formed in pivot body 64. The engagement of disc member 44 with notch 82 further prevents lever 42 from rotating or pivoting about pivot axis 68, and thereby preventing catch 40 from pivoting about pivot point 60.

The combined locking mechanisms of latching surface 80 of lever 42 with mating surface 58 of catch 40, and the further inclusion of disc member 44 engaged with pivot body of lever 42 via notch 82 enables the locked retention of lid 30 to container 26. Furthermore, should container 26 be knocked over by wind or by an animal, or should container 26 be subjected to vibratory stimulus, the combined locking mechanisms are largely capable of retaining lid 30 locked to container 26.

Figure 5:
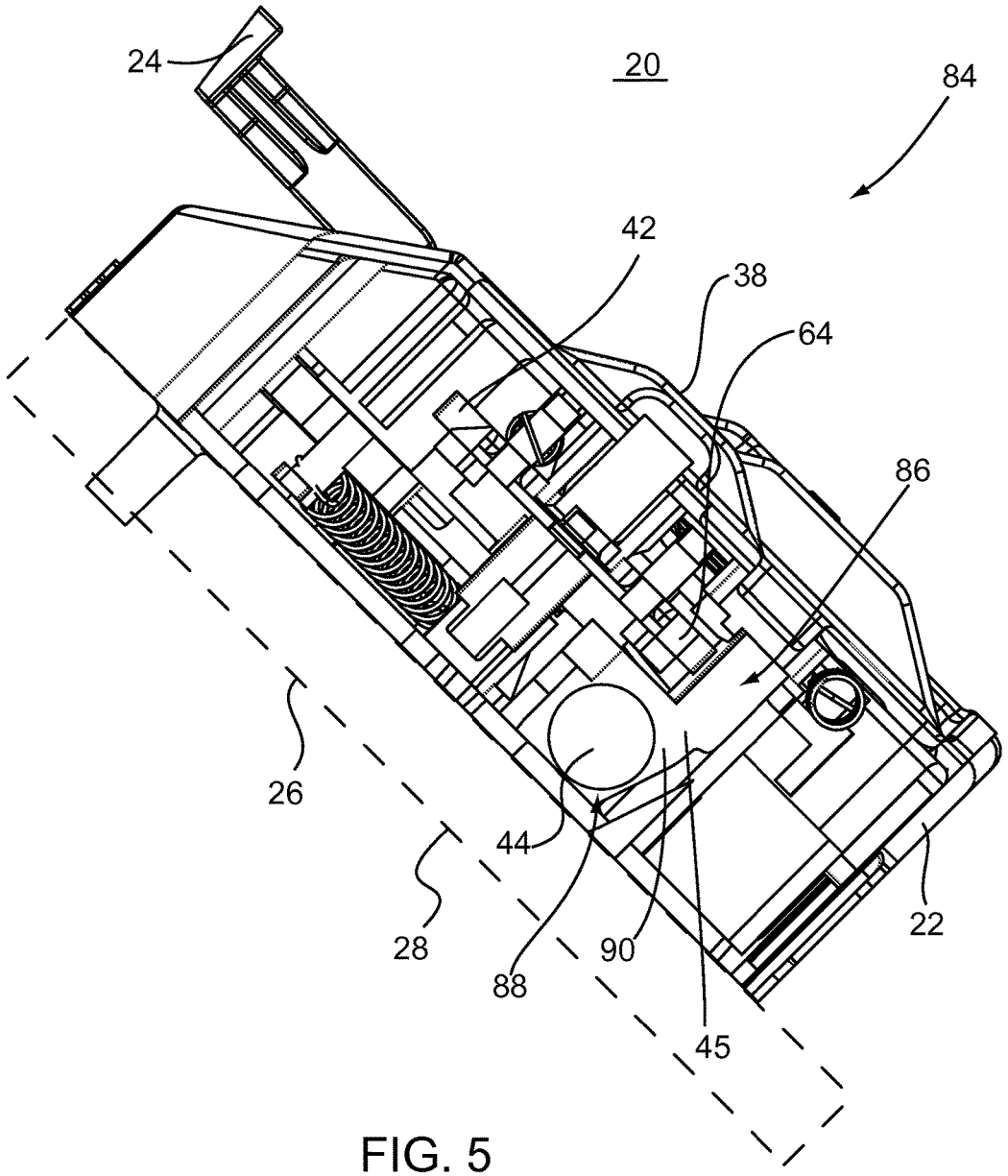
FIG. 5 shows a side view of a first side of the gravity-actuated latch mechanism at an initially tilted position.

FIG. 5 shows a side view of a first side of the gravity-actuated latch mechanism 20 at an initially tilted position 84. Latch mechanism 20 is illustrated with a portion of housing 38 removed so as to better visualize some of the internal components of mechanism 20. Referring briefly to FIG. 3, the portion of housing 38 removed in FIG. 5 is at the right side of the illustration of FIG. 3.

With continued reference to FIG. 5, container 26 (shown in ghost form), with the attached latch mechanism 20, has been picked up by a refuse truck (not shown) and is beginning to be tipped in order to empty container 26. It should be recalled that latch mechanism 20 is mounted to inside front wall 28 of container 26, i.e., the inside of container 26 at the front from which the refuse truck picks up container 26. Accordingly, the refuse truck would be located on the left side of latch mechanism 20 in accordance with FIG. 5. At a tilt of, for example, approximately forty-five degrees, disc member 44 rolls from it rest position 86 engaged with notch 82 (FIG. 7) in pivot body 64 of lever 42 within cavity 45 to a disengaged position 88. Rest position 86 is represented in ghost form by a circle having a white perimeter.

Cavity 45 includes a cavity region 90 displaced forward from lever 42, i.e., displaced toward front wall 28 of container 26. Disengaged position 88 of disc member 44 occurs when disc member 44 rolls into cavity region 90. Cavity 45 may be slot shaped having a width that is only slightly wider than disc member 44 so that disc member 44 is largely prevented from tipping or tilting within cavity region 90. Accordingly, in order to unlock latch mechanism 20, disc member 44 must first roll out of notch 82.

Figure 6:
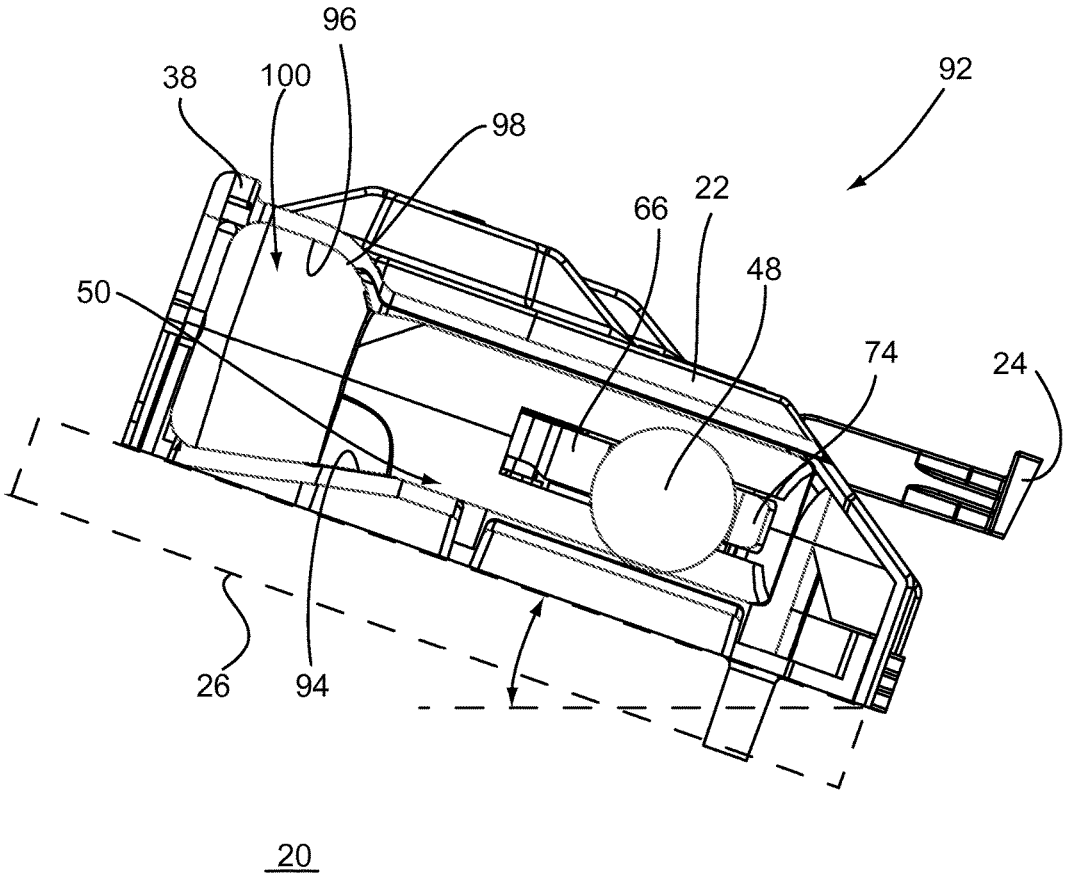
FIG. 6 shows a side view of a second side of the gravity-actuated latch mechanism tilted at a greater angle than that shown in FIG. 5.

Now referring to FIG. 6, FIG. 6 shows a side view of a second side of gravity-actuated latch mechanism 20 tilted at a greater angle than that shown in FIG. 5. Latch mechanism 20 is illustrated with a portion of housing 38 of latch body 22 removed so as to better visualize some of the internal components of mechanism 20. Referring briefly to FIG. 3, the portion of housing 38 removed in FIG. 5 is at the left side of the illustration of FIG. 3. Accordingly, the refuse truck would be located on the right side of latch mechanism 20 in accordance with FIG. 6.

With continued reference to FIG. 6, FIG. 6 shows container 26 (in ghost form) with latch mechanism 20 tilted to an unlock position 92. At a tilt of, for example, approximately fifteen degrees beyond, or below, horizontal, latch actuation ball 48 begins to roll within elongated passage 50 due to the effect of gravity and contacts distal end 74 of lever arm 66 residing in passage 50. That is, the refuse truck continues to move container 26 through a dump cycle creating a steeper angle so that latch actuation ball 48 is able to apply more weight to distal end 74 of lever arm 66 to positively move lever arm 66 to its stop.

It should be observed that a lower inner wall 94 of elongated passage 50 is approximately flat, i.e., without curves, depressions, or pockets. The approximately flat shape of lower inner wall 94 enables latch actuation ball 48 to easily roll in passage 50 when container 26 with latch mechanism 20 is tilted by the refuse truck. Additionally, an upper inner wall 96 includes a shoulder section 98 that forms a pocket 100 within elongated passage 50. Pocket 100 faces the back and sides (see also FIGS. 3 and 7) of container 26 when container 26 is in an upright position. Accordingly, if container 26 falls backward and/or on one of its sides, ball 48 is more likely to roll into and reside in pocket 100 instead of rolling in passage 50 to strike distal end 74 of lever arm 66. Thus, lid (FIG. 1) is more likely to remain locked to container 26 in the event that container 26 is blown over by wind or knocked over by an animal.

Figure 7:
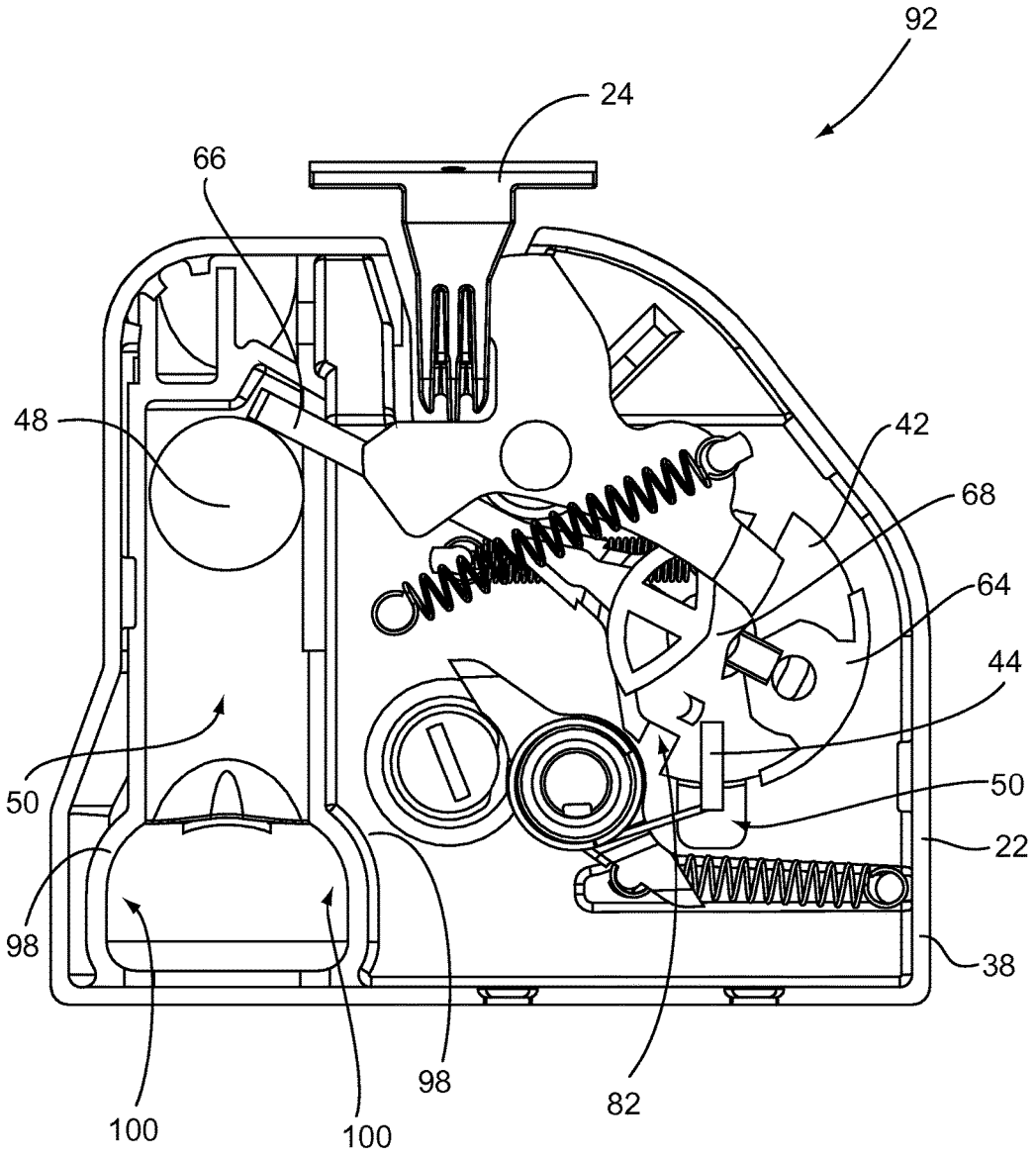
FIG. 7 shows a front view of the gravity-actuated latch mechanism when it has been tilted.

FIG. 7 shows a front view of gravity-actuated latch mechanism 20 when it has been tilted. FIG. 7 generally shows latch mechanism 20 in an upright position for simplicity of illustration. However, the location of ball 48 within elongated passage 50 results when latch mechanism 20 is tilted to unlock position 92 shown in FIG. 6. That is, the components of latch mechanism 20 are shown as they would appear approaching an upside down position of container 26 (FIG. 1) at the midpoint of a dump cycle.

In unlock position 92, disc member 44 has rolled within cavity 50 out of engagement with notch 82 of pivot body 64 of lever 42. More particularly, disc member 44 has rolled toward the front of container 26 to clear notch 82 in pivot body 64. Lever 42 is now free to pivot about its pivot axis 68 because of the weight of latch actuation ball 48 against that portion of lever arm 66 residing in elongated passage 50.

Figure 8:
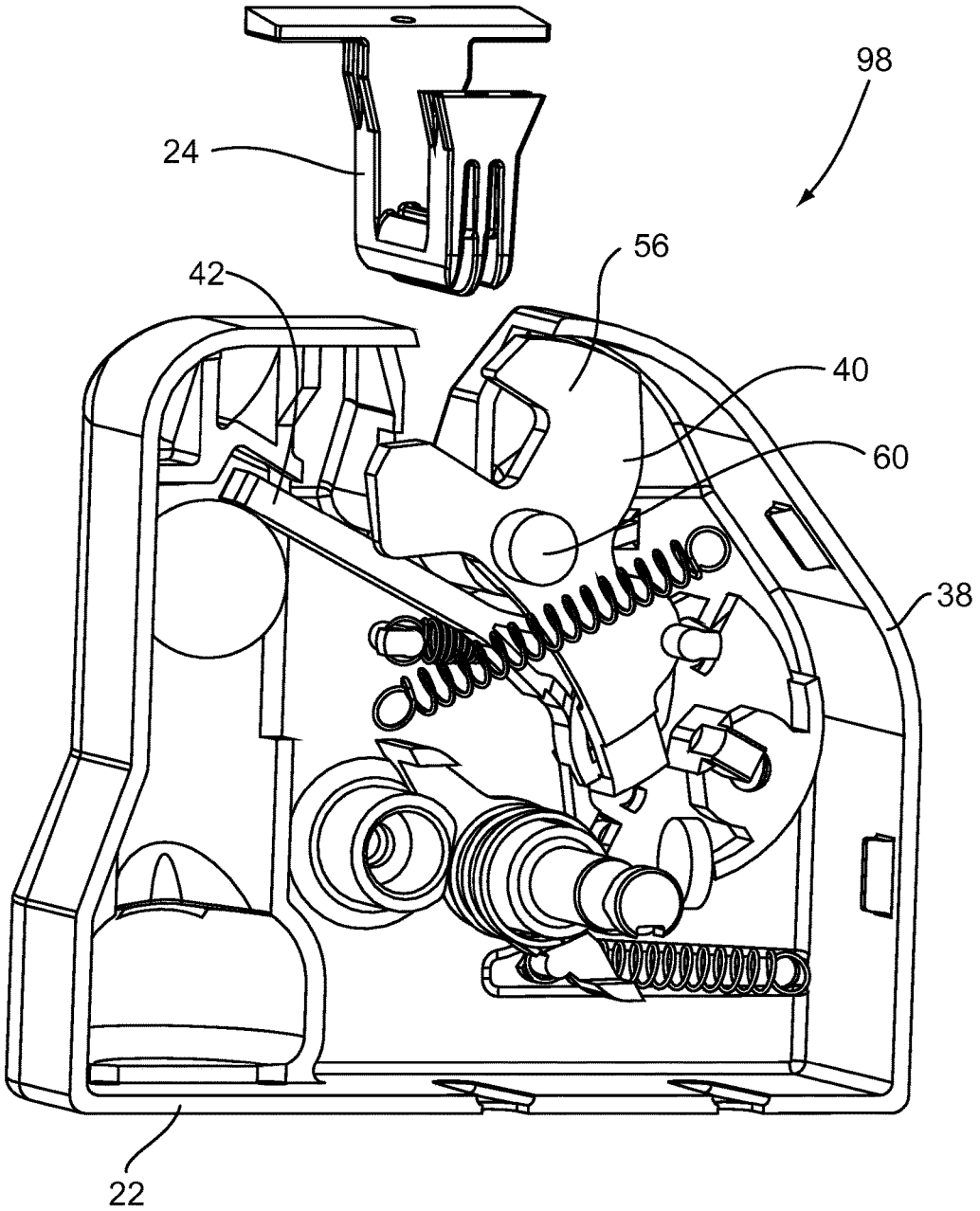
FIG. 8 shows a perspective front view of the gravity-actuated latch mechanism in an unlatched configuration.
Figure 9:
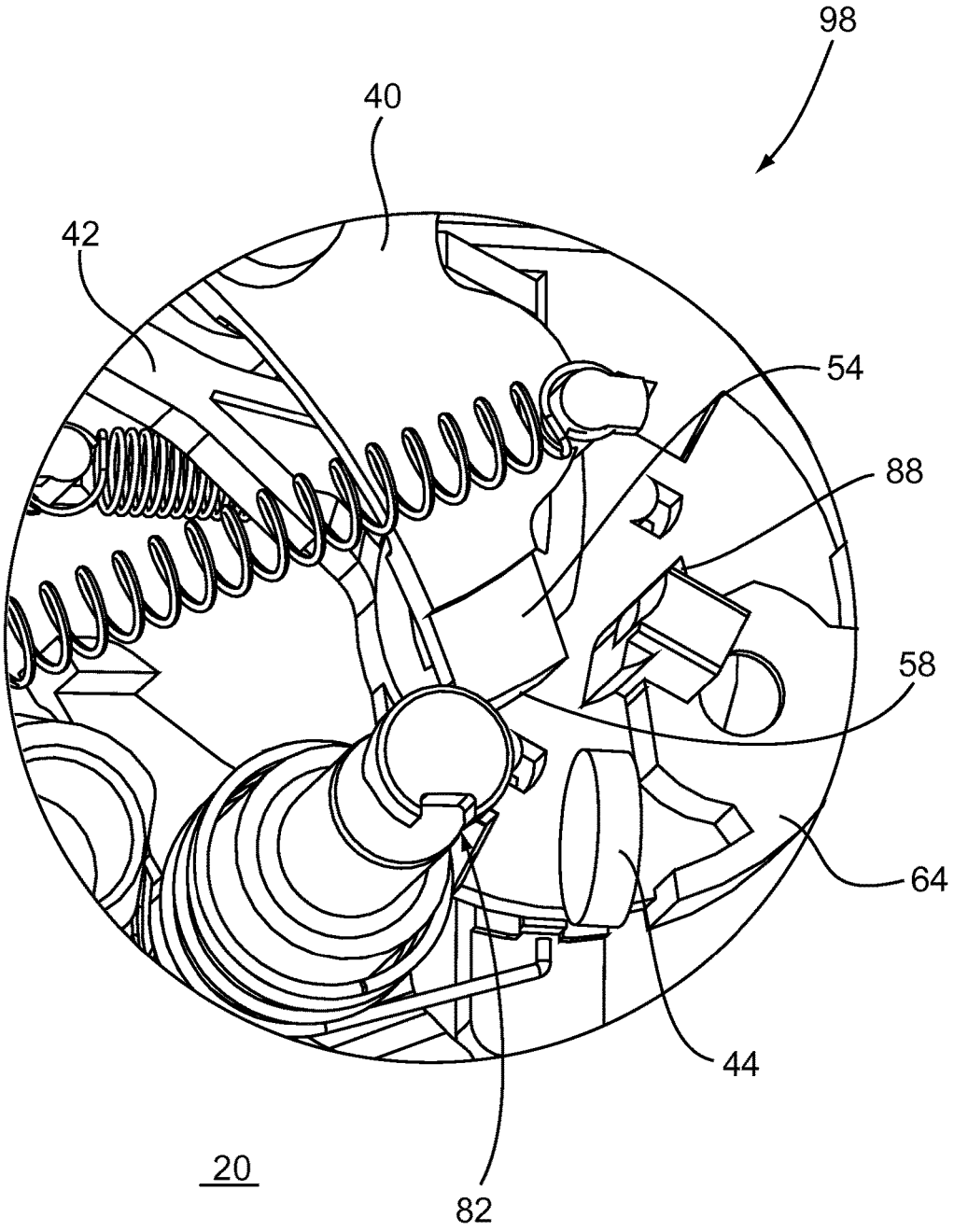
FIG. 9 shows an enlarged partial view of the gravity-actuated latch mechanism shown in FIG. 8.

Referring now to FIGS. 8-9, FIG. 8 shows a perspective front view of gravity-actuated latch mechanism 20 in an unlatched configuration 98, and FIG. 9 shows an enlarged partial view of gravity-actuated latch mechanism 20 in unlatched configuration 98 shown in FIG. 8. With lever 42 moved to its stop position, catch 40 is now free to rotate about its pivot axis 60 so that hook 56 releases from strike 24. Accordingly, lid 30 (FIG. 1) which is secured to strike 24 is allowed to open from its own weight and/or the pressure of refuse against lid 30.

With particular reference to the enlarged partial view shown in FIG. 9, in unlatched configuration 98, latching surface 80 of lever 42 has moved down and out of position to allow mating surface 58 of catch 40 to move past it so as to release strike 24 (FIG. 8). However, when catch 40 rotates, a ledge 100 formed at second end 54 of catch 40 engages a corresponding surface 102 on pivot body 64 of lever 42. This engagement allows catch 40 and lever 42 to reset in the reverse order when container 26 (FIG. 1) is placed back into an upright position in order to prevent jamming and to be ready for the next cycle of moving to unlatched configuration 98. For example, when container 26 is returned to its upright position by the refuse truck, latch actuation ball 48 will return to the bottom of elongated passage 50 and strike 24 will hit catch 40 as lid 30 closes. Thus, catch 40 will pivot about pivot point 60 so that hook 56 engages with strike 24. Concurrently, lever 42 will pivot about pivot point 68 due to the engagement of ledge 100 formed at second end 54 of catch 40 with corresponding surface 102 on pivot body 64 of lever 42. When lever 42 pivots to its original position, disc member 44 will roll into engagement with notch 82 so that latch mechanism 20 is again placed in latched configuration 76 (FIG. 3).

Figure 10:
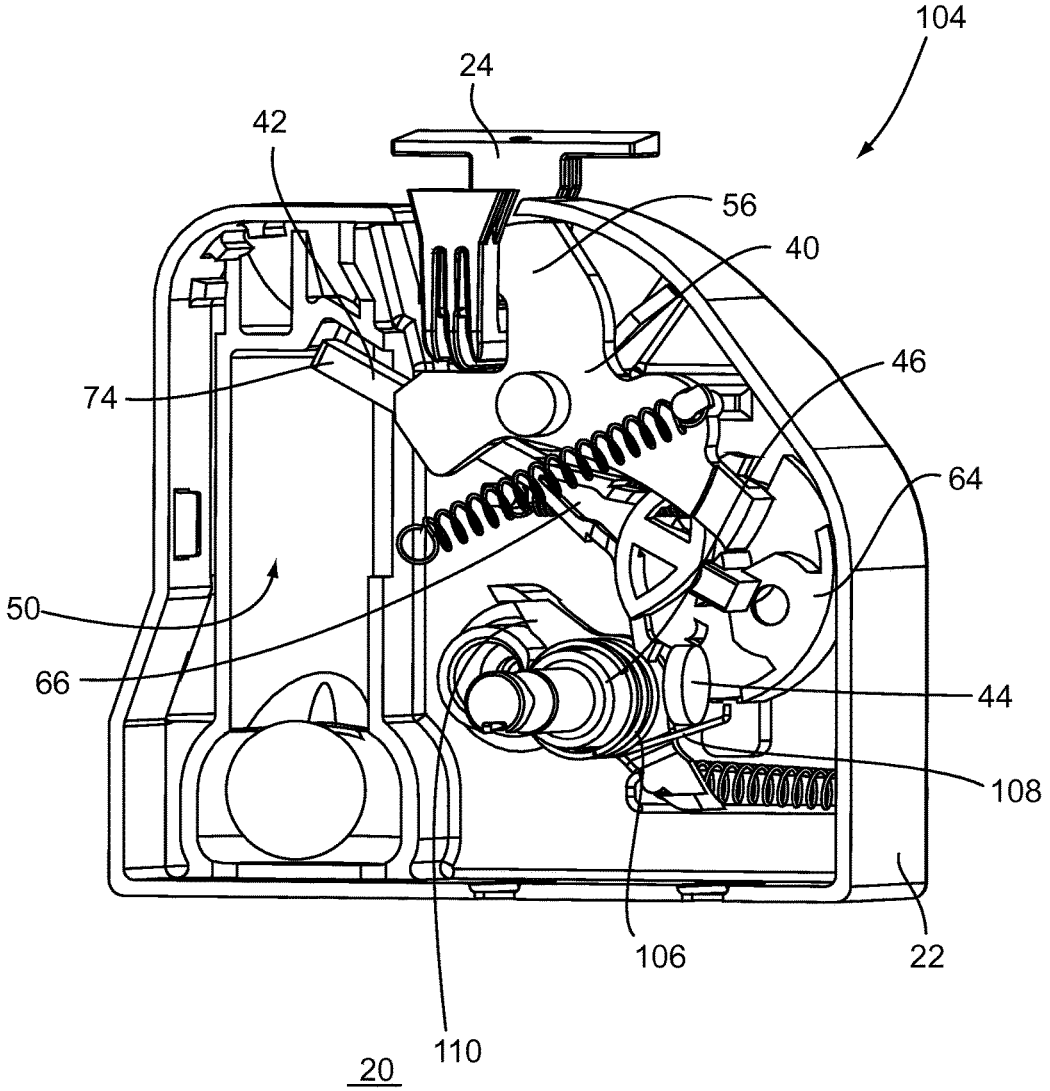
FIG. 10 shows a perspective front view of the gravity-actuated latch mechanism in a manual release configuration.

FIG. 10 shows a perspective front view of gravity-actuated latch mechanism 20 in a manual release configuration 104. It is typically necessary for a user to have the ability to unlock latch mechanism 20 in order to place refuse into container 26 (FIG. 1). In order to open lid 30 (FIG. 1) manually, manual open actuator 46 is manipulated by the user. In an embodiment, the user could manually pull a knob (not shown) of manual open actuator 46 outwardly from an exterior of container 26 and then rotate manual open actuator 46 in a clockwise direction. The two action, pull and turn capability of manual open actuator 46 makes it difficult for a clever and persistent animal, such as a raccoon, to figure out how to manually unlock latch mechanism 20.

A spring element 106 of manual open actuator 46 has a spring end 108 in communication with disc member 44. When the knob of manual open actuator 46 is pulled outwardly, disc member 44 moves forward and out of engagement with notch 82 in pivot body 64 so that lever 42 can be rotated. Rotating manual open actuator 46 in a clockwise direction causes a wing feature 110 of actuator 46 to push upwardly on lever arm 66 causing lever 42 to pivot so that distal end 74 of lever arm 66 moves upwardly in elongated passage 50 to its stop position. With lever 42 moved to its stop position, catch 40 is now free to rotate so that hook 56 releases from strike 24, as discussed above. Accordingly, lid 30 (FIG. 1) which is secured to strike 24 can be opened by the user in order to place material inside of container 26. Closing lid 30 resets latch mechanism 20, as discussed in connection with FIG. 9.

Figure 11:
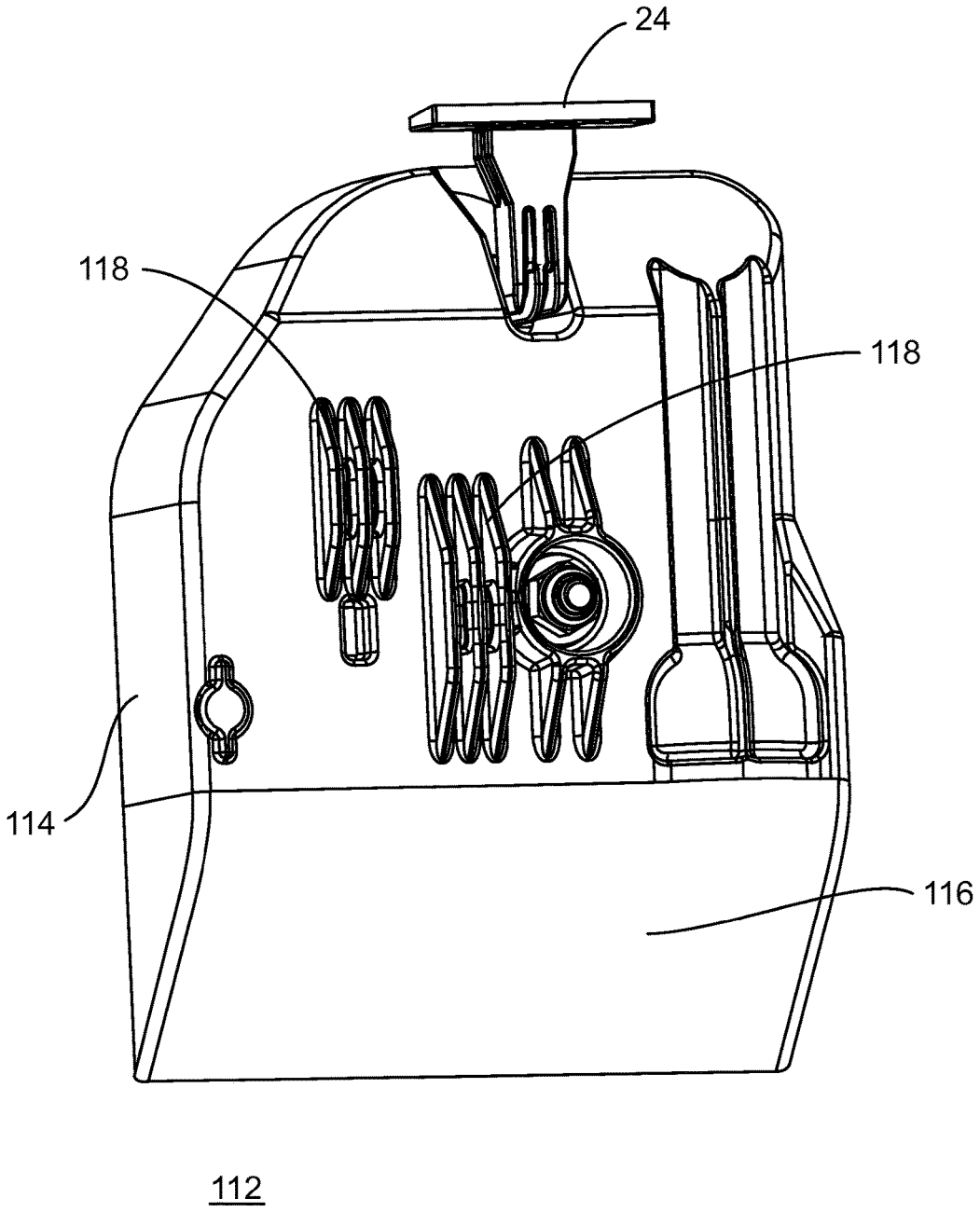
FIG. 11 shows a back perspective view of the gravity-actuated latch mechanism in accordance with an alternative embodiment.

FIG. 11 shows a back perspective view of a gravity-actuated latch mechanism 112 in accordance with an alternative embodiment. Gravity-actuated latch mechanism 20 of FIG. 1-10 has a flat bottom. Such a flat bottom may be required for use in containers that have an inwardly extending ledge formed to facilitate pickup by a refuse truck. In general, the flat bottom of latch mechanism 20 may reside in close proximity to the inwardly extending ledge. This internal ledge serves as a shed to deflect waste smoothly as container 26 is being dumped.

However, when such a ledge is not present, a housing 114 of latch mechanism 112 may be suitably shaped to have a shed 116, or sloped region, as part of housing 114 that serves to deflect waste smoothly as container 26 (FIG. 1) is being dumped. Additionally, or alternatively, latch mechanism 112 may include suitably formed rib structures 118 formed on housing 114. Rib structures 118 may be formed over and around outwardly projecting features of latch mechanism 112 to protect the features and to deflect waste as container 26 is being dumped.

Figure 12:
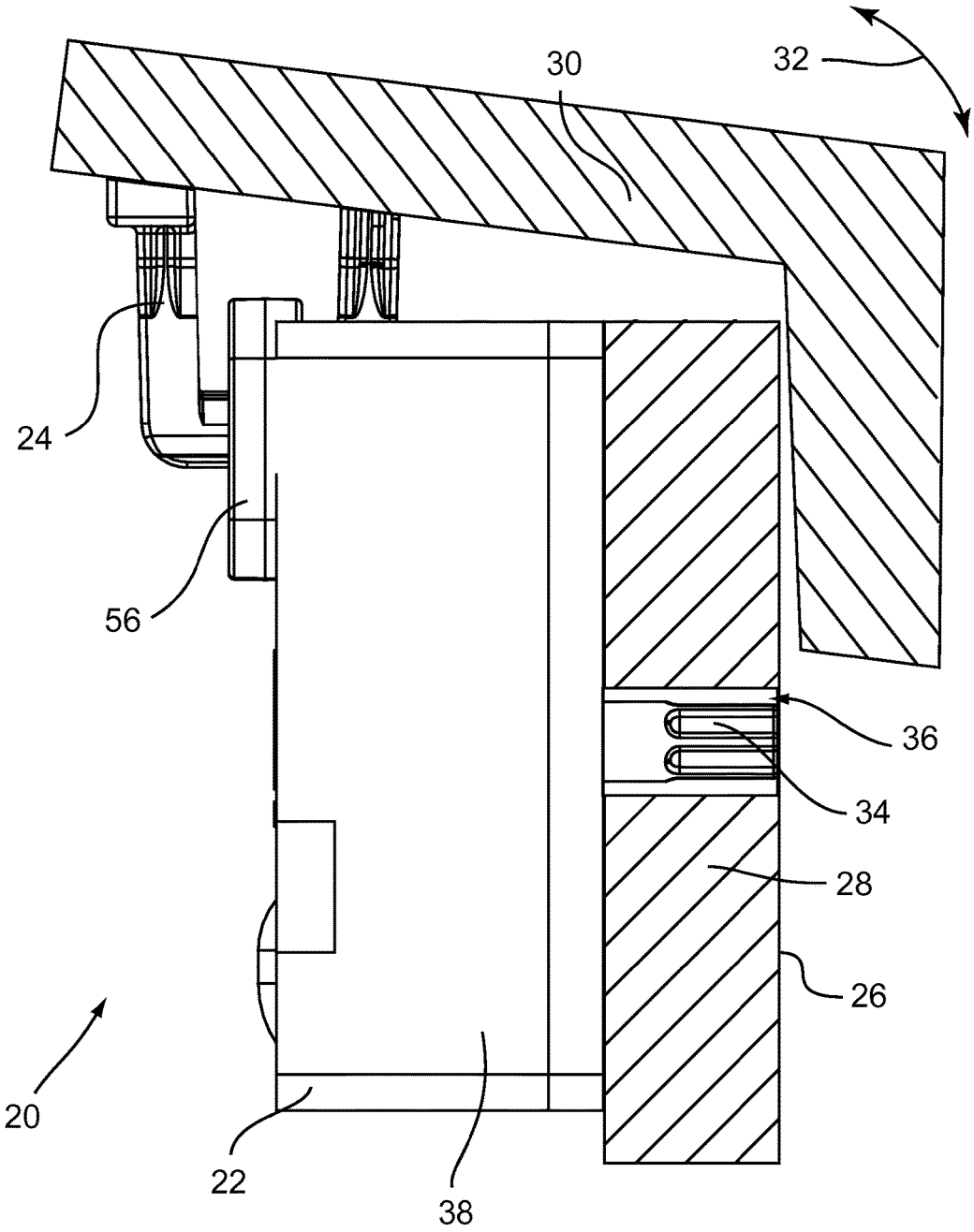
FIG. 12 shows a side view of a gravity-actuated latch mechanism in accordance with an embodiment.
Figure 13:
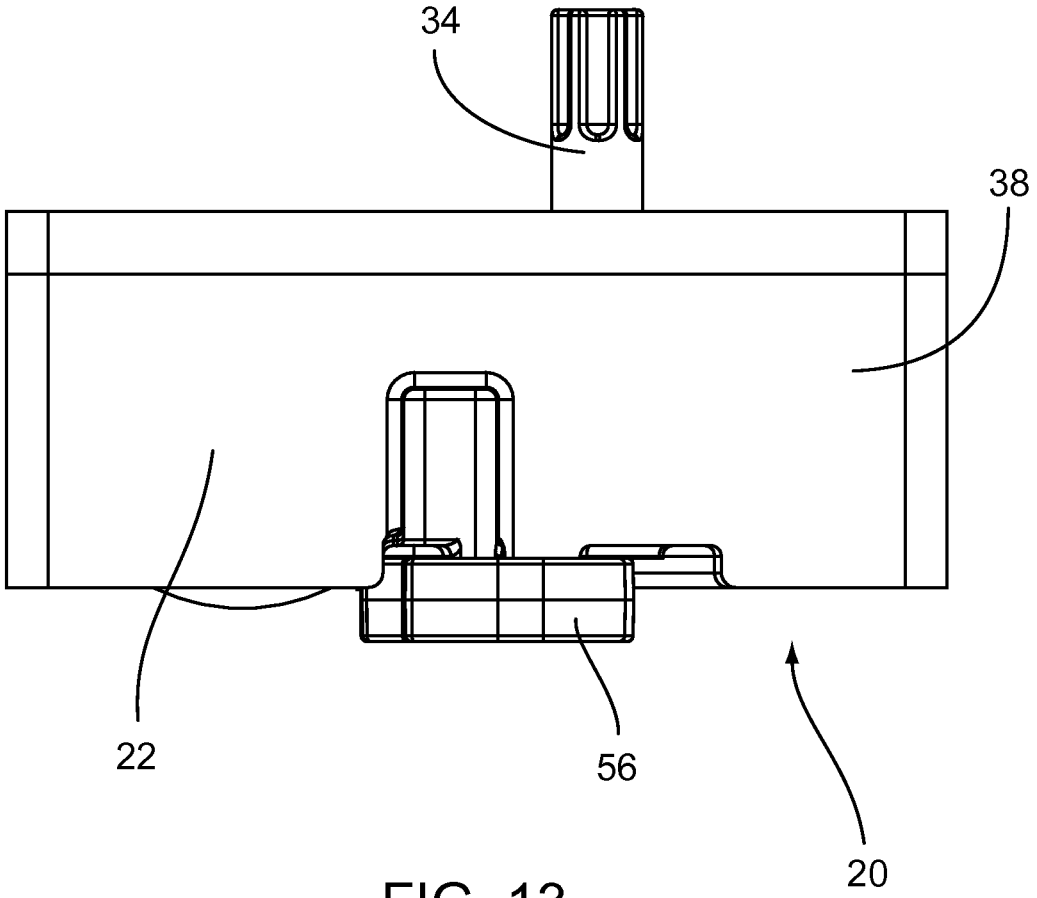
FIG. 13 shows a top view of the gravity-actuated latch mechanism.
Figure 14B:
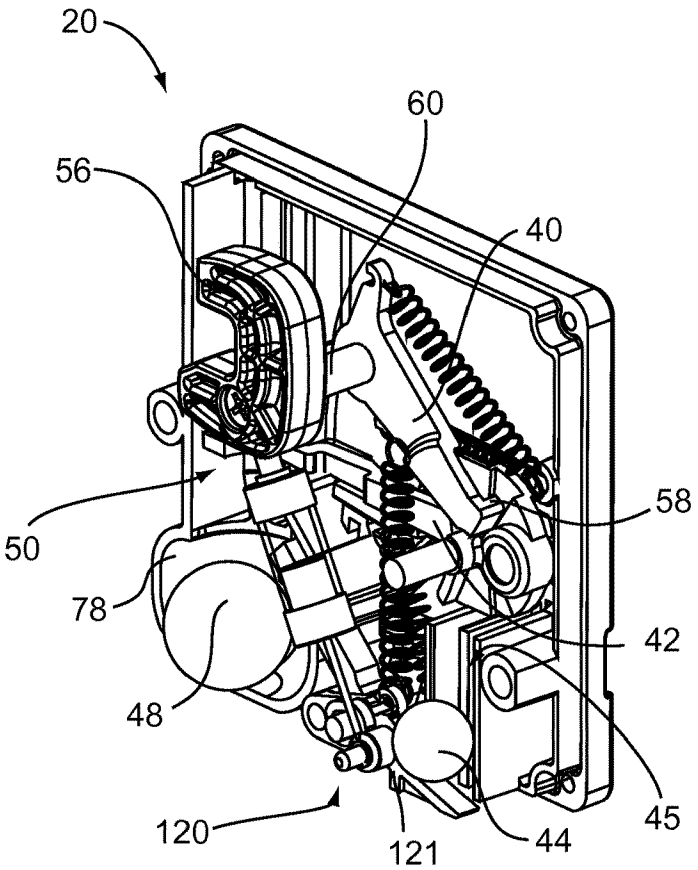
FIG. 14B shows a front perspective view of the gravity-actuated latch mechanism.

Referring to FIGS. 12-14B, FIG. 12 shows a side view of a gravity-actuated latch mechanism 20 in accordance with an embodiment. FIG. 13 shows a top view of gravity-actuated latch mechanism 20. FIG. 14A shows a front view of gravity-actuated latch mechanism 20, and FIG. 14B shows a front perspective view of gravity-actuated latch mechanism 20. In FIGS. 14A and 14B, a rear housing of latch mechanism 20 has been removed to better visualize the internal components (discussed below) of latch mechanism 20.

In an embodiment, latch mechanism 20 includes a latch body 22 and a strike 24. In general, latch body 22 is adapted to be secured to an inside front wall 28 of a container 26 with a top edge of latch body being mounted flush with the top edge of front wall 28. Strike 24 is adapted to be fastened to a lid 30 that closes, or covers, an opening into container 26. For purposes of illustration, a portion of container 26 with lid 30 is shown in FIG. 12. A bi-directional curved arrow 32 shows a direction of movement of lid 30 relative to front wall 28 of container 26. That is, a hinged member (not shown) interconnects lid 30 with a back wall (not shown) of container 26 to enable movement of lid 30 relative to container 26.

In an embodiment, a fastener (not shown) may extend through another opening (not shown) in front wall 28 and secure to, for example, a threaded opening (not shown) in latch body 22. Those skilled in the art will recognize that a variety of fasteners and fastening techniques may be implemented to secure latch body 22 to front wall 28 of container 26. Similarly, strike 24 may be fastened to lid 30 utilizing a variety of fasteners and fastening techniques known to those skilled in the art. Additionally, the latch mechanism 20 is drip proof.

Latch body 22 functions cooperatively with strike 24 so that lid 30 is secured to front wall 28 of container 26 to inhibit intrusion into container 26, as will be discussed in greater detail below. In addition, latch mechanism 20 can be readily actuated by a gravity effect when the gripping arm of an automated collection refuse pickup vehicle picks up and tilts container 26 to disengage strike 24 from latch body 22, as will also be discussed in greater detail below.

Figure 14A:
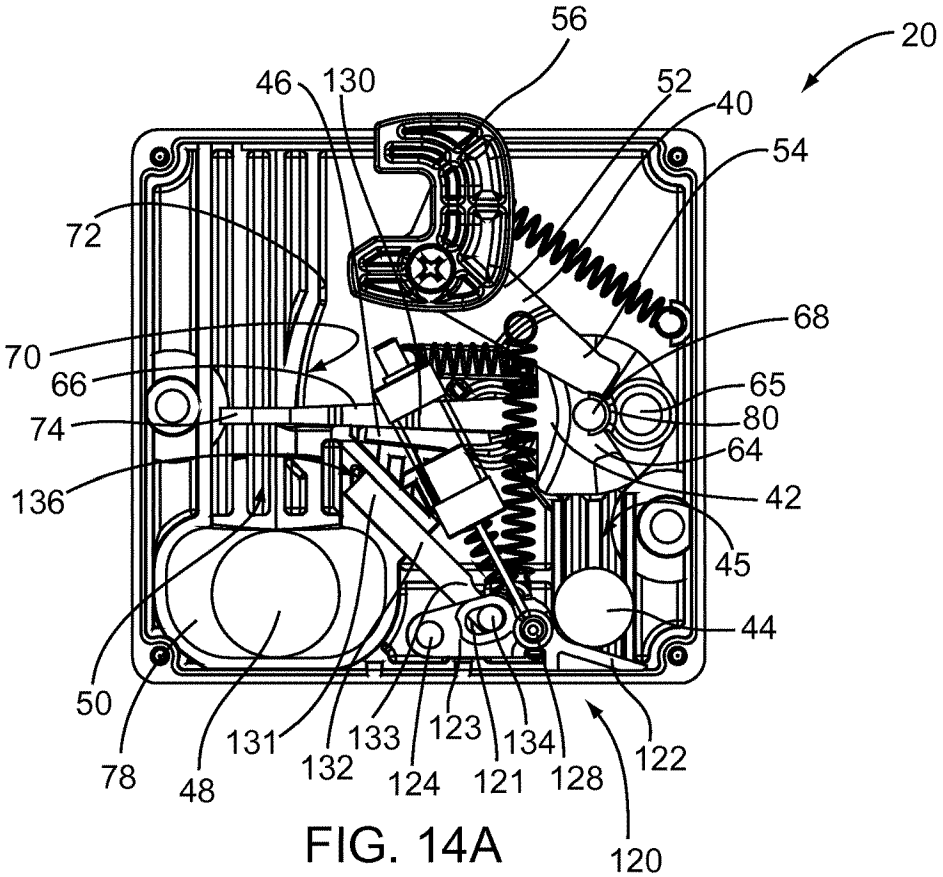
FIG. 14A shows a front view of the gravity-actuated latch mechanism.

Referring more particularly to FIGS. 14A and 14B, multiple components of latch mechanism 20 reside within a housing 38 of latch body 22. The components of latch mechanism 20 generally include a catch 40, a lever 42, a secondary lock actuation member 44 housed in a first elongate passage 45, a manual open actuator 46, and a latch actuation member 48 housed in an elongated passage 50 within housing 38. It will be understood that as shown, the secondary lock actuation member 44 is a secondary lock actuation ball 44 and the latch actuation member 48 is a lock actuation ball 48. Further the secondary lock actuation member 44 and the latch actuation member 48 may be any shape.

Catch 40 includes a first end 52 and a second end 54. A hook 56 is rotatably coupled to first end 52 of catch 40 and is adapted to engage with strike 24. A mating surface 58 is located at second end 54 of catch 40 and is adapted to at least partially engage with lever 42 (discussed below). When actuated, catch 40 is adapted to selectively pivot, or rotate, about a pivot axis 60 to release hook 56 from engagement with strike 24. Lever 42 includes a pivot body 64 and a lever arm 66 extending from pivot body 64. Lever 42 is adapted to selectively pivot, or rotate, about another pivot axis 68. Lever arm 66 extends through a slot 70 in a wall 72 enclosing elongated passage 50 so that a distal end 74 of lever arm 66 resides in elongated passage 50.

Pivot body 64 includes a counterweight 65. Counterweight 65 balances the weight of lever arm 66, wherein the weight of counterweight 65 may be slightly less than, equal to, or slightly greater than the weight of lever arm 66 and still keep latch mechanism 20 from opening with a knock over of refuse container 26. It is understood that a return spring may compensate for minor imbalances in lever arm 64 with counterweight 65. Because of counterweight 65, when refuse container 26 is knocked over, the resulting force towards the top of refuse container 26 does not cause the lever arm 66 to move towards the top of latch body 22, which would open it. The center of gravity of lever 42 is approximately at the center of rotation of pivot axis 68. Counterweight 65 also very slightly impedes the opening of latch mechanism 20 during a dump cycle but the weight of latch actuation ball 48 makes the amount of resistance from counterweight 65 irrelevant.

FIGS. 14A and 14B show latch mechanism 20 in a latched configuration. More particularly, latch actuation ball 48 resides at the bottom of elongated passage 50 in a reservoir portion 78 of passage 50 when latch mechanism 20 is upright due to the effect of gravity. Distal end 74 of lever arm 66 is oriented approximately horizontal so that a latching surface 80 extending outwardly from pivot body 64 of lever 42 abuts, latches to, or otherwise engages with mating surface 58 at second end 54 of catch 40. The engagement between latching surface 80 of lever 42 and mating surface 58 of catch 40 largely prevents catch 40 from pivoting about pivot point 60 so that hook 56 remains engaged with strike 24.

Secondary lock actuation member 44 is implemented as part of a secondary lock mechanism 120. Secondary lock mechanism 120 includes a secondary lock lever arm 121 having a first end 122 and a second end 123. A pivot axis 124 is located at second end 123 of secondary lock lever arm 121. Secondary lock mechanism 120 further includes a dampening device 130 operatively coupled to secondary lock lever arm 121 at connection 128. Secondary lock mechanism 120 also includes a plunger 132 that travels through an elongate passage 136. Plunger 132 includes a first end 131 and a second end 133. Plunger 132 also includes a protrusion 134 located at second end 133. Protrusion 134 engages an aperture 126 of secondary lock lever arm 121 to operatively coupled plunger 132 to secondary lock lever arm 121. The elongate aperture 126 may have an elongate shape in order to translate rotational movement of secondary lock lever arm 121 about pivot axis 124 to a linear movement of plunger 132 through an elongate passage 136. Elongate passage 136 extends into elongate passage 50.

In the upright position as shown in FIGS. 14A and 14B, secondary lock actuation member 44 engages first end 122 of secondary lock lever arm 121 to prevent rotation of secondary lock lever arm 121. A spring is operatively coupled to secondary lock lever arm 121 and biases it to rotate and the weight of secondary lock actuation member 44 creates a force stronger than the force of the spring and therefore prevents rotation of secondary lock lever arm 121. It will be understood that secondary lock mechanism 120 may be used in situations where large animals, such as bears, that can turn refuse container 26 upside down.

The combined locking mechanisms of latching surface 80 of lever 42 with mating surface 58 of catch 40, and the further inclusion of secondary lock mechanism 120 enables the locked retention of lid 30 to container 26. Furthermore, should container 26 be knocked over by wind or by an animal, or should container 26 be subjected to vibratory stimulus, the combined locking mechanisms are largely capable of retaining lid 30 locked to container 26.

Figure 15B:
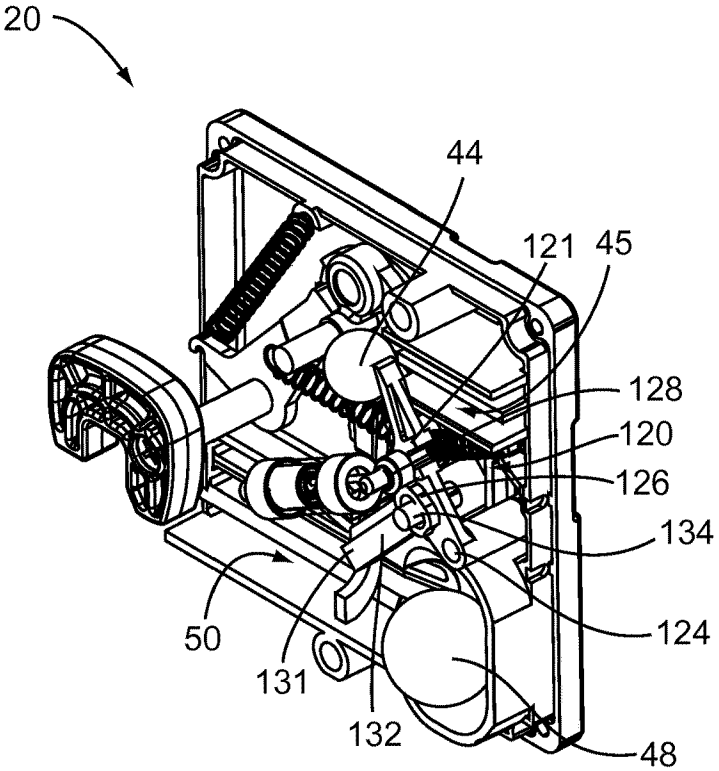
FIG. 15B shows a perspective view of the gravity-actuated latch mechanism at a tilted position.
Figure 15A:
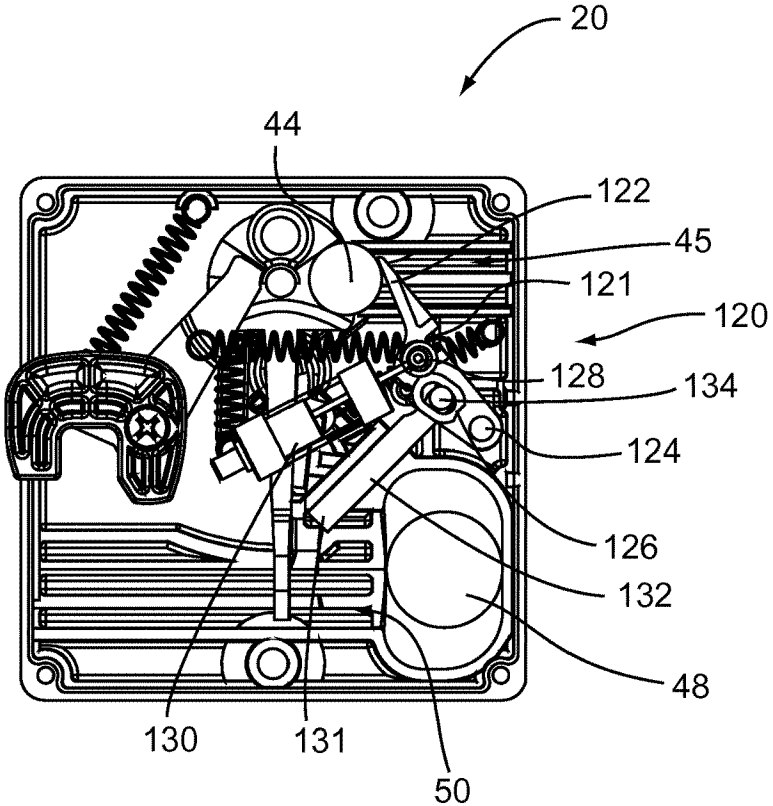
FIG. 15A shows a front view of the gravity-actuated latch mechanism at a tilted position.
Figure 16B:
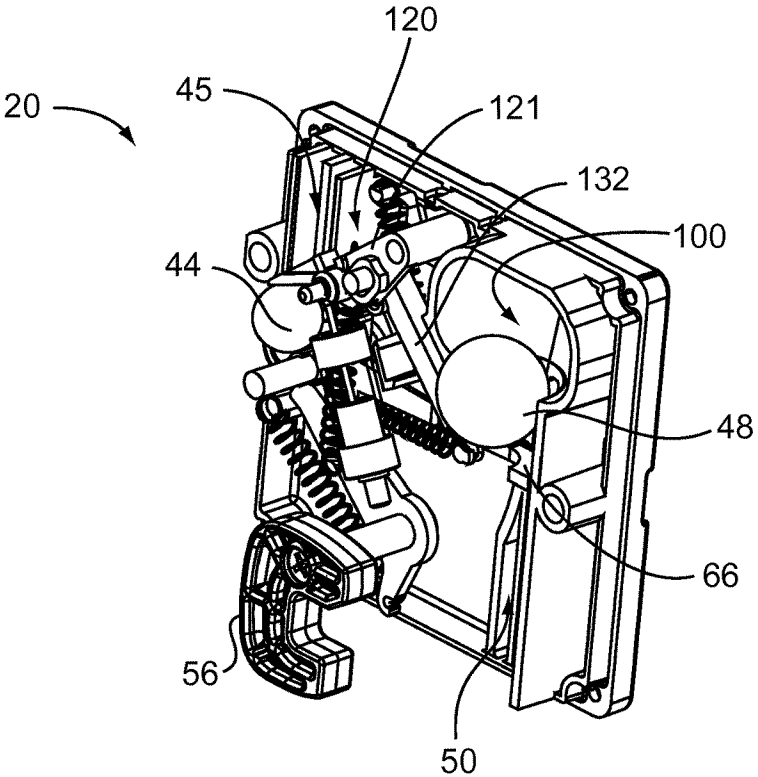
FIG. 16B shows a perspective view of the gravity-actuated latch mechanism in an inverted position.
Figure 16A:
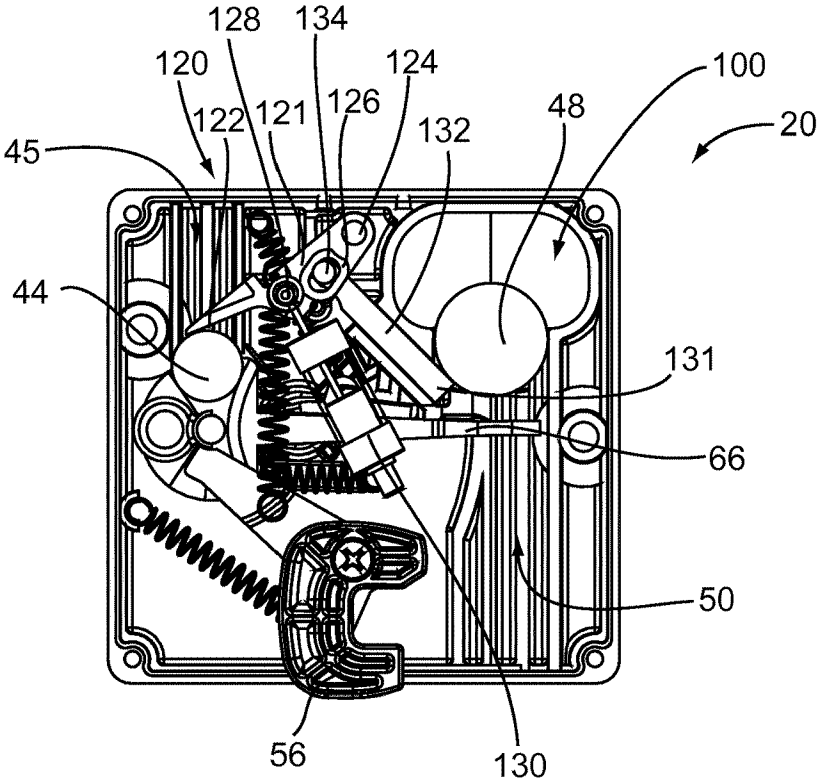
FIG. 16A shows a front view of the gravity-actuated latch mechanism in an inverted position.

FIGS. 15A and 15B show a respective side and perspective view of the gravity-actuated latch mechanism 20 at a tilted position. FIGS. 16A and 16B show a respective side and perspective view of the gravity-actuated latch mechanism 20 at an inverted position Latch mechanism 20 is illustrated with a portion of housing 38 removed so as to better visualize some of the internal components of mechanism 20. Referring briefly to FIG. 12, the portion of housing 38 removed in FIGS. 15A and 15B is at the left side of the illustration of FIG. 12.

With continued reference to FIGS. 15A and 15B, container 26 (not shown), with the attached latch mechanism 20, has been knocked over by wind or an animal. In this condition, secondary lock actuation ball 44 rolls along elongate passage 45. The spring coupled to secondary lock lever arm 121 rotates secondary lock lever arm 121 from the position shown in FIG. 14A to the position shown in FIG. 15A. Plunger 132 moves linearly within elongate passage 136 until first end 131 of plunger 132 extends into elongate passage 50. Dampening device 130 controls the length time needed for secondary lock lever arm 121 to rotate and ultimately the time needed to move first end 131 of plunger 132 into elongate passage 50.

With continued reference to FIGS. 16A and 16B, container 26 (not shown) with the attached latch mechanism 20, has been further pushed into an inverted position by an animal. In this condition, first end 131 of plunger 132 is extending into elongate passage 50. In this position, plunger 132 inhibits movement of latch actuation ball 48 through elongate passage 50. Because latch actuation ball 48 cannot move along elongate passage 50, lever arm 66 is never engaged by latch actuation ball 48 and cannot unlock latch mechanism 20 to release strike 24. In other words, the lid 30 remains in a locked position with regard to refuse container 26.

When refuse can 26 (not shown) is returned to upright position, secondary lock actuation ball 44 moves along elongate passage 45 and engages first end 122 of secondary lock lever arm 121 and rotates secondary lock lever arm 121 as gravity acts on secondary lock actuation ball 44. The rotation of secondary lock lever arm 121 into a position shown in FIG. 14A results in linearly moving plunger 132 through elongate passage 136 and removing first end 131 from within elongate passage 50.

Figure 17B:
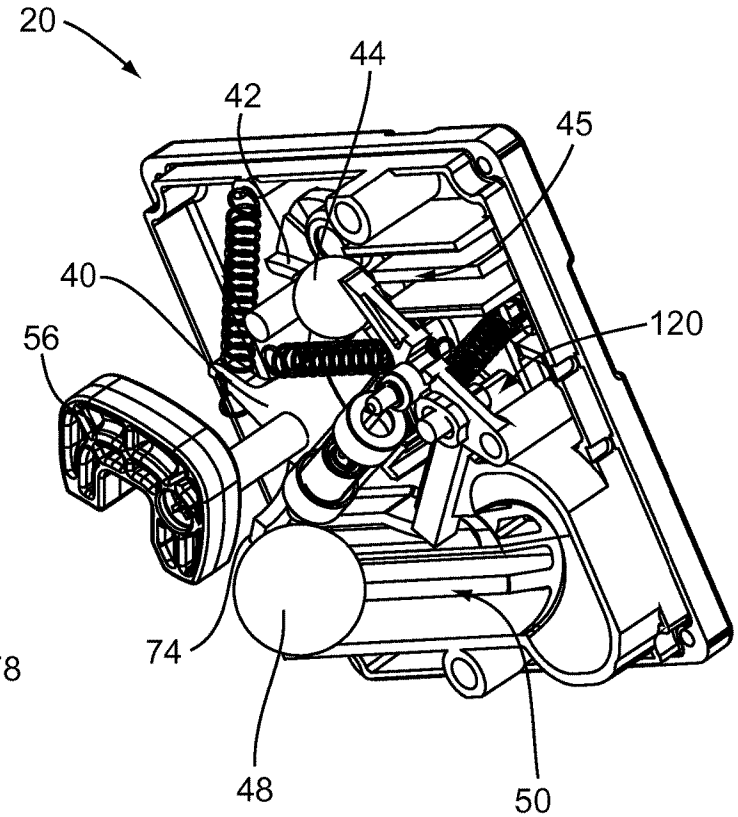
FIG. 17B shows a perspective view of the gravity-actuated latch mechanism in normal dump cycle.
Figure 17A:
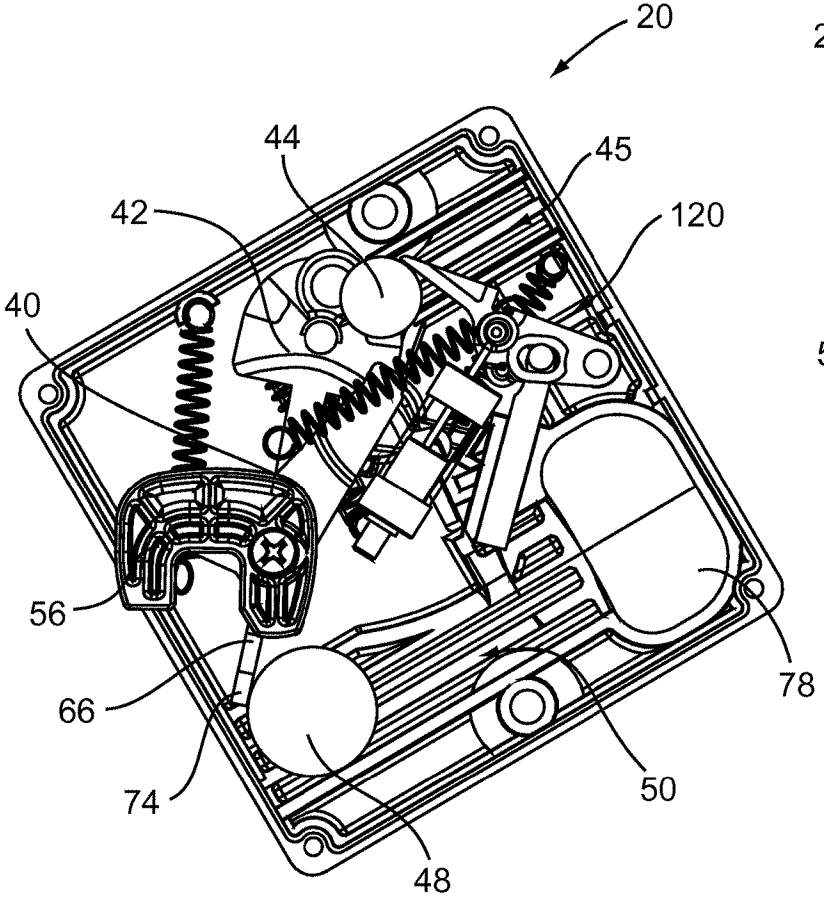
FIG. 17A shows a front view of the gravity-actuated latch mechanism in normal dump cycle.
Figure 18B:
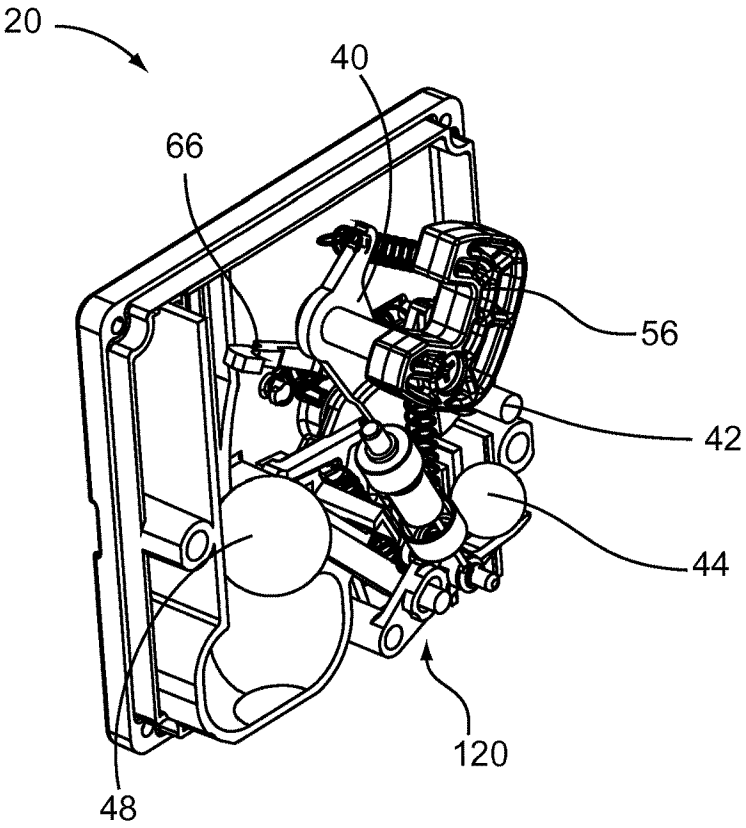
FIG. 18B shows a perspective view of the gravity-actuated latch mechanism in a return position after a normal dump cycle.
Figure 18A:
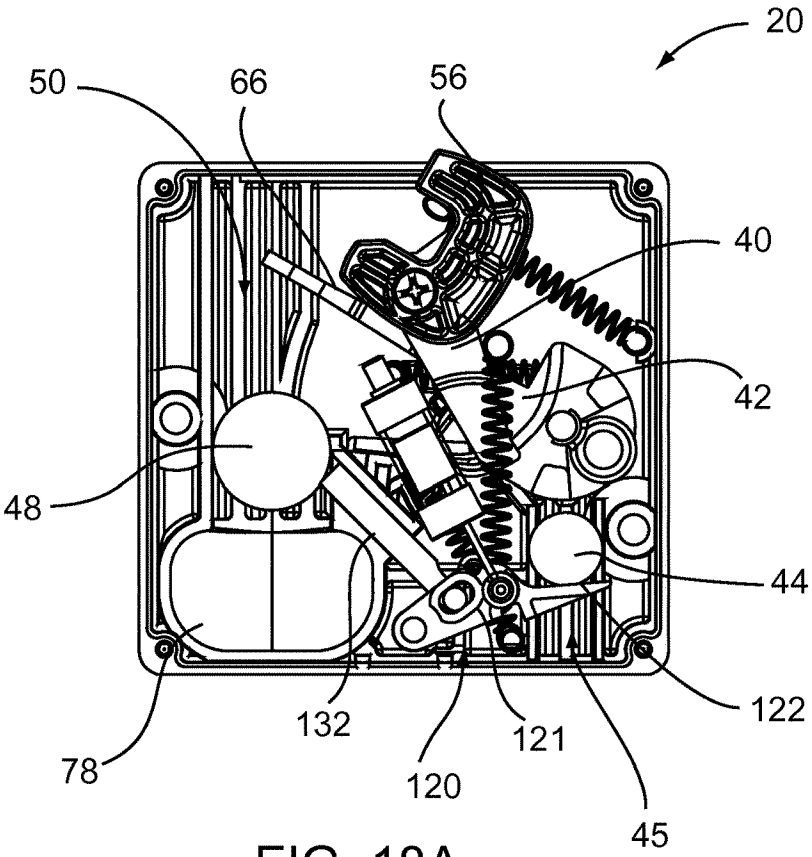
FIG. 18A shows a front view of the gravity-actuated latch mechanism in a return position after a normal dump cycle.

FIGS. 17A and 17B show a respective side and perspective view of latch mechanism 20 in normal dump cycle and FIGS. 18A and 18B show a respective side and perspective view latch mechanism in a return position after a normal dump cycle. Referring briefly to FIG. 12, the portion of housing 38 removed in FIGS. 17A-18B is at the left side of the illustration of FIG. 12. Accordingly, the refuse truck would be located on the right side of latch mechanism 20 in accordance with FIG. 12 or the back of FIG. 17A.

With continued reference to FIGS. 17A and 17B, refuse container 26 (not shown), with the attached latch mechanism 20, has been picked up by a refuse truck (not shown) and is tipped in order to empty container 26. It should be recalled that latch mechanism 20 is mounted to inside front wall 28 of container 26, i.e., the inside of container 26 at the front from which the refuse truck picks up container 26. In other embodiments, latch mechanism 20 may be mounted on an outside wall, in a pocket and the like so long as latch mechanism 20 is operable.

As refuse can 26 tilts from a refuse truck, latch mechanism 20 begins to tilt. At a tilt of, for example, approximately fifteen degrees beyond, or below, horizontal, latch actuation ball 48 begins to roll within elongated passage 50 due to the effect of gravity and contacts distal end 74 of lever arm 66 residing in passage 50. That is, the refuse truck continues to move container 26 through a dump cycle creating a steeper angle so that latch actuation ball 48 is able to apply more weight to distal end 74 of lever arm 66 to positively move lever arm 66 to its stop.

It should be observed that a lower inner wall (not shown) of elongated passage 50 is approximately flat, i.e., without curves, depressions, or pockets. The approximately flat shape of lower inner wall enables latch actuation ball 48 to easily roll in passage 50 when container 26 with latch mechanism 20 is tilted by the refuse truck. Because of the timing of a normal dump cycle and the shape of lower inner wall, latch actuation ball 48 rolls in elongate passage past the location of where elongate passage 136 engages elongate passage 50. This is accomplished because dampening device 130 controls the time for secondary lock mechanism 120 to operate to extend plunger 132 into elongate passage 50. It will be understood that dampening device 130 can ensure that rotation of secondary lock lever arm 121 takes any predetermined amount of time. In some embodiments, the time is four seconds. In other embodiments, it is more or less than four seconds. Additionally, an upper inner wall includes a shoulder section located on a portion of the housing not shown that forms a pocket 100 within elongated passage 50. Pocket 100 faces the back and sides of container 26 when container 26 is in an upright position. Accordingly, if container 26 falls backward and/or on one of its sides, ball 48 is more likely to roll into and reside in pocket 100 instead of rolling in passage 50 to strike distal end 74 of lever arm 66. Thus, lid 30 (FIG. 12) is more likely to remain locked to container 26 in the event that container 26 is blown over by wind or knocked over by an animal.

Referring further to FIGS. 17A and 17B, in the normal dump cycle; latch mechanism is moved into an unlatched configuration. In this condition, latching surface 80 of lever 42 has moved down and out of position to allow mating surface 58 of catch 40 to move past it so as to release strike 24. This engagement allows catch 40 and lever 42 to reset in the reverse order when container 26 (FIG. 12) is placed back into an upright position in order to prevent jamming and to be ready for the next cycle of moving to unlatched configuration.

For example, and with reference to FIGS. 18A and 18B, when container 26 is returned to its upright position by the refuse truck, latch actuation ball 48 will return to the bottom of elongated passage 50 engaging first end 131 of plunger 132 and push plunger 132 in elongated passage 136 while secondary lock actuation ball 44 engages first end 122 of secondary lock lever arm 121 to work in conjunction with latch actuation ball 48 to move secondary lock mechanism 120 into position shown in FIG. 14A. Lever 42 will not return until strike 24 rotates hook 56 as lid 30 closes.

It is typically necessary for a user to have the ability to unlock latch mechanism 20 in order to place refuse into container 26 (FIG. 12). In order to open lid 30 (FIG. 12) manually, manual open actuator 46 is manipulated by the user by rotation of manual open actuator 46. In an embodiment, a manual open shaft 34 extending outwardly from latch body 22 may be directed through an opening 36 extending through front wall 28. A user may rotate manual open shaft 34 to then rotate manual open actuator 46 to engage lever arm 66 of lever 42 and to rotate lever arm 66 to manually rotate latch mechanism 20 into an unlatched position. In another embodiment, the user could manually pull a knob (not shown) of manual open actuator 46 outwardly from an exterior of container 26 and then rotate manual open actuator 46. The two action, pull and turn capability of manual open actuator 46 makes it difficult for a clever and persistent animal, such as a raccoon, to figure out how to manually unlock latch mechanism 20. The rotation of manual open actuator 46 engages lever arm 66 of lever 42 and rotates it, thereby manually rotating latch mechanism 20 into an unlatched position.

Figure 19:
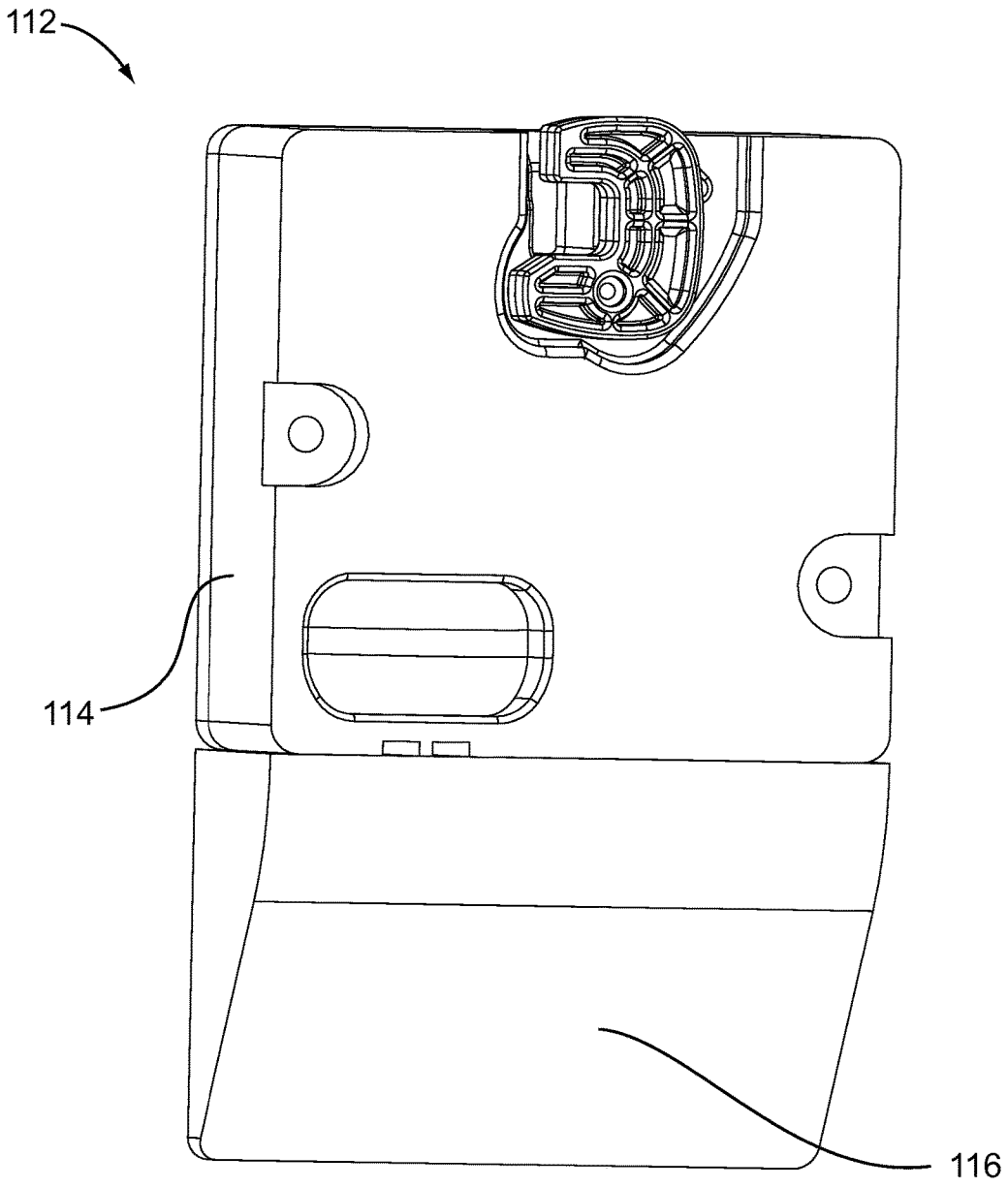
FIG. 19 shows a back perspective view of a gravity-actuated latch mechanism.

FIG. 19 shows a back perspective view of a gravity-actuated latch mechanism 112 in accordance with an alternative embodiment. Gravity-actuated latch mechanism 20 of FIG. 12-18B has a flat bottom. Such a flat bottom may be required for use in containers that have an inwardly extending ledge formed to facilitate pickup by a refuse truck. In general, the flat bottom of latch mechanism 20 may reside in close proximity to the inwardly extending ledge. This internal ledge serves as a shed to deflect waste smoothly as container 26 is being dumped.

However, when such a ledge is not present, a housing 114 of latch mechanism 112 may be suitably shaped to have a shed 116, or sloped region, as part of housing 114 that serves to deflect waste smoothly as container 26 (FIG. 12) is being dumped.

Embodiments described herein entail a gravity-actuated latch mechanism that may be utilized in conjunction with an enclosure, such as a container with a lid. The latch mechanism may be implemented with a refuse container, lock box, or any other container that may receive and hold items such as food, garbage, trash, recyclable items, and so forth. More particularly, the latch mechanism is configured to inhibit smaller animals such as raccoons, squirrels, dogs, and the like, from accessing the contents of the container. Furthermore, the latch mechanism includes a gravity-actuated lever and catch structural configuration that is resists unlatching in the instance that the container is tipped over by, for example, the wind or an animal. The latch mechanism automatically engages so that a user need not deliberately re-engage the latch after placing refuse in the container. Furthermore, the latch mechanism can be unlatched by an automated, mechanical arm of a refuse truck so that the contents of the container can be emptied during automated collection.

Although the preferred embodiments of the invention have been illustrated and described in detail, it will be readily apparent to those skilled in the art that various modifications may be made therein without departing from the spirit of the invention or from the scope of the appended claims.

The invention claimed is:

1. A gravity-actuated latch mechanism comprising:

a strike configured to attach to a lid of a container; and a latch body configured to attach to an inside wall of the container, wherein the latch body comprises:

a housing;

a catch accessible by the strike from outside of the housing, wherein the catch engages the strike to secure the strike to the catch and disengages the strike to release the strike from the catch;

a lever having a lever arm moveable between an engaged position and a disengaged position, wherein the lever arm is engaged with the catch in the engaged position and the lever arm is disengaged with the catch in the disengaged position; and a latch actuation ball housed in an elongated passage within the housing, wherein the lever arm of the lever extends into the elongate passage, and wherein the latch actuation ball applies force to the lever arm to move the lever from the engaged position to the disengaged position in response to the latch actuation ball moving along the elongated passage during tipping of the container for dumping and engaging the lever arm with the applied force caused by gravity acting on the latch actuation ball.

2. The mechanism of claim 1, wherein the catch comprises a hook, wherein the hook engages and disengages the strike.

3. The mechanism of claim 1, further comprising a disc member corresponding to a notch in the lever.

4. The mechanism of claim 3, wherein the disc member is moveable between and engaged position with the notch and a disengaged position with the notch, wherein the disc member in the engaged position with the notch prevents movement of the lever and the disc member in the disengaged position with the notch allows movement of the lever.

5. The mechanism of claim 4, wherein the disc member moves from the engaged position to the disengaged position in response to tipping the container for dumping.

6. A gravity-actuated latch mechanism comprising:

a strike configured to attach to a lid of a container; and a latch body configured to attach to an inside wall of the container, wherein the latch body comprises:

a housing;

a catch accessible by the strike from outside of the housing through an opening in the housing, wherein the catch engages with the strike to secure the strike to the catch and disengages with the strike to release the strike from the catch;

a lever having a lever arm moveable between an engaged position and a disengaged position, wherein the lever arm is engaged with the catch while in the engaged position and the lever arm is disengaged with the catch while in the disengaged position;

a latch actuation ball housed in an elongated passage within the housing, wherein the lever arm of the lever extends into the elongated passage, and wherein the latch actuation ball applies force to the lever arm to move the lever from the engaged position to the disengaged position in response to the latch actuation ball moving along the elongated passage during tipping of the container for dumping and engaging the lever arm with the applied force caused by gravity acting on the latch actuation ball; and a secondary lock mechanism for maintaining the catch secured to the strike by preventing the latch actuation ball from engaging the lever arm during accidental tipping of the container.

7. The mechanism of claim 6, wherein the secondary lock mechanism comprises:

a secondary lock actuation member housed in a secondary lock elongated passage within the housing;

a secondary lock lever arm having a first end and a second end, the first end extending into the secondary lock elongate passage; and a pivot axis located at the second end of the secondary lock lever arm, wherein the secondary lock actuation member engages the first end of the secondary lever arm when the container is in an upright position and disengages the first end of the secondary lever arm when the container is tipped over.

8. The mechanism of claim 7, wherein the secondary lock mechanism further comprises a plunger that travels through a plunger elongate passage, wherein the plunger comprises a first end and a second end, and a protrusion located at second end.

9. The mechanism of claim 8, wherein the protrusion engages an aperture of secondary lock lever arm to operatively couple the plunger to secondary lock lever arm.

10. The mechanism of claim 9, wherein the aperture of the secondary lock lever arm has an elongate shape to translate rotational movement of secondary lock lever arm about pivot axis to a linear movement of the plunger through the plunger elongate passage.

11. The mechanism of claim 10, wherein the plunger elongate passage extends into the elongate passage of the housing.

12. The mechanism of claim 11, wherein the plunger extends into the elongate passage of the housing in response to the secondary lock actuation member disengaging the secondary lock lever arm.

13. The mechanism of claim 12, wherein the secondary lock mechanism further comprises a dampening device operatively coupled to secondary lock lever arm.

14. The mechanism of claim 13, wherein the dampening device controls a length of time needed for the secondary lock lever arm to rotate.

15. The mechanism of claim 14, wherein the dampening device controls a length of time needed for the plunger to extend the protrusion into the elongate passage of the housing by controlling the length of time needed for the secondary lock lever arm to rotate.

* * * * *